United States Patent [19]

Stern et al.

[11] Patent Number: 4,639,156

[45] Date of Patent: Jan. 27, 1987

[54] PAINTING APPARATUS AND METHOD

[76] Inventors: Donald J. Stern, 127 Underhill Rd.; Jon I. Allsop, 2317 N. Shore Rd., both of Bellingham, Wash. 98225

[21] Appl. No.: 614,253

[22] Filed: May 25, 1984

[51] Int. Cl.[4] ..... B43K 5/02

[52] U.S. Cl. ..... 401/146; 401/188 R; 401/197; 200/83 Z; 417/477

[58] Field of Search ..... 401/146, 149, 150, 188 R, 401/187, 197, 208, 196; 417/477; 200/83 Z

[56] References Cited

U.S. PATENT DOCUMENTS

| | | | |
|---|---|---|---|
| 673,960 | 5/1901 | Looker . | |
| 756,695 | 4/1904 | Peterson . | |
| 2,281,773 | 5/1942 | Kollmann . | |
| 2,357,763 | 9/1944 | Pratt | 401/197 |
| 2,478,318 | 8/1949 | Raub, Jr. . | |
| 2,541,301 | 2/1951 | Sissler | 401/197 X |
| 2,606,334 | 8/1952 | Vaden et al. | 401/197 |
| 2,627,620 | 2/1953 | Gudze . | |
| 2,677,839 | 5/1954 | Dean | 401/197 |
| 2,882,541 | 4/1959 | Easley . | |
| 2,960,040 | 11/1960 | Bischoff . | |
| 3,020,579 | 2/1962 | O'Connor | 401/188 R |
| 3,134,130 | 5/1964 | Chadwick, II . | |
| 3,195,170 | 7/1965 | Howard | 401/188 |
| 3,230,570 | 1/1966 | Flippen . | |
| 3,336,625 | 8/1967 | Carlee . | |
| 3,372,976 | 3/1968 | MacFarland | 401/197 |
| 3,457,017 | 7/1969 | Bastian . | |
| 3,539,268 | 11/1970 | Stebbins | 401/197 |
| 3,591,319 | 7/1971 | Shlisky | 417/477 |
| 3,724,016 | 4/1973 | Sopper . | |
| 3,812,782 | 5/1974 | Funahashi | 401/197 X |
| 3,816,035 | 6/1974 | Malbec | 417/477 |
| 3,873,790 | 3/1975 | Coons | 200/832 |
| 4,072,429 | 2/1978 | Terzian et al. . | |
| 4,175,300 | 11/1979 | McGlen et al. . | |
| 4,209,883 | 7/1980 | Hawk . | |
| 4,217,062 | 8/1980 | Trp et al. | 401/197 X |
| 4,231,668 | 11/1980 | Groth et al. | 401/146 |
| 4,302,122 | 11/1981 | Moya . | |
| 4,540,301 | 9/1985 | Swanson et al. | 401/197 X |

FOREIGN PATENT DOCUMENTS

| | | | |
|---|---|---|---|
| 822859 | 9/1969 | Canada | 401/197 |
| 899008 | 5/1972 | Canada | 401/197 |
| 1047686 | 5/1957 | Denmark . | |
| 2256428 | 5/1974 | Fed. Rep. of Germany | 401/197 |
| 1035235 | 4/1953 | France . | |
| 2236448 | 2/1975 | France . | |
| 2463303 | 2/1981 | France . | |
| 1296033 | 11/1972 | United Kingdom . | |
| 1415788 | 11/1975 | United Kingdom | 401/197 |

*Primary Examiner*—Richard J. Apley
*Assistant Examiner*—Robert W. Bahr
*Attorney, Agent, or Firm*—Hughes & Cassidy

[57] ABSTRACT

A painting system having a supply section, a delivery and control section, and an applicator section. The supply section comprises a peristaltic type pump. The delivery and control section comprises a unitary tube having a delivery passageway and an air pressurizing passageway. A pressurizing control switch at the location of the applicator acts through the air passageway to control operation of the pump. The applicator section has a housing which provides a uniform pattern of distribution passageways for uniform application of paint.

48 Claims, 21 Drawing Figures

PAINTING APPARATUS AND METHOD

FIELD OF THE INVENTION

The present invention relates to a method and apparatus for applying a liquid, such as paint, as in painting a wall or ceiling, and more specifically to a powered system for delivering paint from a supply source and discharging it from an applicator.

BACKGROUND ART

A common method of applying paint to a surface is to use a cylindrically shaped paint roller or roller applicator, or a flat applicator pad. The roller or pad is commonly dipped into a supply of paint, with some of the paint being absorbed in the roller or pad, and then the roller or pad is carried to the wall surface so that the paint can be applied to such surface. Because of the time consumed in moving back and forth between the paint source and the surface to be painted, various powered painting systems have been proposed where the paint is delivered under power to the paint applicator. However, there are a number of basic design problems or considerations which have warranted further efforts toward improvement. Among these are the following.

One area of concern is the manner in which the paint is fed from the applicator to the paint surface. Desirably, this should be done in a controlled manner so that the paint is delivered at the proper rate, and also accomplished in such a manner that the paint is distributed with the proper uniformity or regularity to the painting surface. Also, there is the problem of controlling the flow of paint to the applicator. This should be done so that the control system is reliable and relatively simple, and yet be convenient to operate. Since the control switch should desirably be in the vacinity of the applicator, and since the paint is generally delivered from a source remote from the applicator, there must be an effective means of communicating the control signals from the area of the applicator to the supply area.

Further, with regard to the source or supply of the paint, there are important design considerations relative to the manner in which the paint is delivered through a tube or other feed mechanism to the applicator. Desirably, this should be done with a mechanism which is relatively simple and reliable, and yet properly responsive to the control mechanism of the system.

With regard to overall design considerations, obviously convenience and reliability are of prime importance. Other considerations are that the various components of the system lend themselves to easy maintenance and cleaning. There are yet other areas of concern in the design of such apparatus, and many of these will become evident in the later discussion of the advantageous features of the present invention.

The patent literature discloses a number of paint systems and other devices relative to the application of paint or other liquid, and these are given below.

U.S. Pat. No. 673,960, Looker, illustrates a "fountain" roller, moistener, and sealer, where the fluid passes from the tank through the handle to a roller that applies the liquid.

U.S. Pat. No. 756,695, Peterson, shows a roller applicator where the liquid is stored within the roller, and a tube arrangement causes the rotation of the roller to distribute the liquid.

U.S. Pat. No. 2,281,773, Kollmann, shows a fluid applicator where there is a roller, and there is a fluid control means positioned within the handle for the applicator.

U.S. Pat. No. 2,478,318, Raub Jr., shows another paint applicator of the roller type, where paint is supplied through the roller handle to pass outwardly through the roller.

U.S. Pat. No. 2,627,620, Gudze, shows a roller applicator where the paint or other liquid is supplied from a pressurized tank through the handle to the roller.

U.S. Pat. No. 2,677,839, Dean, shows another arrangement where the liquid is fed from a pressurized container through the handle to the roller that applies the paint.

U.S. Pat. No. 2,882,541, Easley, shows a system where there is a roller paint applicator with a tube extending down the middle of the roller, there are a plurality of laterally extending passageways which lead from a center feed tube to the roller surface.

U.S. Pat. No. 2,960,040, Bischoff, shows a roller applicator where there is a pump connected to the handle to which the roller is mounted.

U.S. Pat. No. 3,134,130, Chadwick II, shows a pressure fed liquid applicator where the liquid is fed into the interior of a belt that is partially mounted on a cylindrical rotatable core.

U.S. Pat. No. 3,230,570, shows a fluid application device where there is a peristaltic pump used to deliver the fluid.

U.S. Pat. No. 3,336,625, Carlee, shows a paint roller where paint is poured into a center tube and flows into a plurality of cups mounted within the roller. The paint is distributed from these cups to the surface of the roller.

U.S. Pat. No. 3,457,017, Bastion, shows a painting system where there is a peristaltic pump that feeds the paint through a flexible tube to a roller. There is an electrical switch at the location of the handle for the roller to control operation of the pump.

U.S. Pat. No. 3,724,016, Soffer, shows a roller applicator where the roller itself is motor driven. The roller is filled with paint through an end opening.

U.S. Pat. No. 4,175,300, McGlew et al, shows a motor driven roller where the paint passes to the surface of the roller through a plurality of feed tubes. Each of the feed tubes may be individually controlled.

U.S. Pat. No. 4,217,062, Trp et al, shows a paint feeding apparatus where the paint is moved to a roller by a peristaltic pump. The roller has a single passage from the center tube in the roller to permit the paint to flow into the space beneath the surface of the roller.

U.S. Pat. No. 4,231,668, Groth et al, shows another system where a peristaltic pump delivers the paint to the roller. The pump has a planetary gear system which causes the pumping action against the flexible tube.

U.S. Pat. No. 4,302,122, Moya, shows a rotating brush for the application of paint. Paint is supplied from a tank by a pump, and there is a motor which drives the brush member itself.

SUMMARY OF THE INVENTION

The system of the present invention is particularly adapted to be utilized as a painting system and comprises a supply section, an applicator section, and a delivery and control section. The supply section comprises a pump adapted to pump liquid paint from a paint source. The applicator section comprises an applicator to dispense the paint from the applicator.

In the preferred form, the delivery and control section comprises the following:

1. a delivery tube having a receiving end to receive the paint from the pump, a delivery passageway to carry the paint, and a discharge end to deliver paint to the applicator;
2. an actuating tube having an interior passageway to carry a fluid, said tube having a first end proximate to the supply section and a second end proximate to the applicator section;
3. a pressure responsive switch operatively connected to the activating tube and to the pump to cause the pump to operate, said switch having an "on" position and an "off" position;
4. a pressurizing switch proximate to the applicator section and operatively connected to the second end of the activating tube, said pressurizing switch having a release position where fluid pressure in the actuating tube is decreased to move the pump switch to its "off" position to inactivate the pump and interrupt delivery of paint, and a pressurizing position where it moves the pump switch to its "on" position to activate the pump to cause delivery of the paint.

In the preferred form, the pressurizing switch in its release position is arranged to expose the actuating tube to atmospheric pressure, and in its pressurizing position to close the actuating tube passageway to atmospheric pressure. The pressurizing switch further comprises a compressible tube section having a tube interior communicating with the passageway of the actuating tube. This tube section is arranged so that with the pressurizing switch in its release position, the tube interior is open to ambient atmosphere, and with the pressurizing switch in its pressurizing position, the tube interior is closed to ambient atmosphere.

The pressurizing switch further comprises a pressurizing member movable from a release position on a path to first close the compressible tube section to ambient atmosphere and then move further relative to said tube section to compress said tube section and pressurize the passageway of the actuating tube. In the preferred form, the pressurizing member comprises a roller member positioned to roll along a lengthwise dimension of the compressible tube section. The roller member has guide means to position the roller member so as to close off the tube section and progressively compress the tube section. When the roller member is in its pressurizing position, engagement with the compressible tube section holds the roller member in its pressurizing position.

In the preferred form, the delivery and control section comprises a handle adapted to be grasped manually, and also adapted to be connected to the applicator. The handle defines a through passage for the flow of paint, and also contains the compressible tube section. The handle has a lengthwise axis, and in the preferred form the roller is mounted for movement along said lengthwise axis.

Another facet of the present invention is that the pump has a pump motor with a motor switch. The pressure responsive pump switch comprises structure defining a pressure chamber, a diaphragm closing one side of the pressure chamber, and being responsive to increased pressure in the chamber to move outwardly from the chamber. There is an actuating arm positioned to be responsive to outward movement of the diaphragm to move the motor switch to cause the motor to operate and activate the pump. In the preferred form, the actuating arm has a first pivot end by which it is mounted to structure, and a second actuating end to engage the motor switch. The diaphragm engages the actuating arm intermediate its pivot end cause its actuating end cause a correspondingly greater movement of the actuating end relative to the movement of the diaphragm.

As a further specific improvement, the pump switch comprises a first housing section defining the pressurizing chamber and communicating with the passageway of the actuating tube, and a second housing section engaging the first housing section. The diaphragm is positioned between the first and second housing sections so as to close the pressure chamber. The actuating arm is positioned between the diaphragm and the second housing section. Further, the actuating arm is mounted to the second housing section.

According to another feature of the present invention, the delivery tube and the actuating tube are formed as an interconnected tube assembly, which is desirably a single unitary tube member providing the two passageways. Further, there is a connecting adaptor positioned at the receiving end of the delivery tube and at the first end of the actuating tube. The adaptor has a first connecting portion adapted to be connected to the actuating tube, a second connecting portion adapted to be connected to the delivery tube, and a third connecting portion adapted to be connected to a feed tube leading from the pump. Also in the preferred form, the connecting adaptor comprises fourth and fifth connecting portions to complete the total circulation system for the paint. The connecting adaptor can be made as a member integral with the first housing section of the pump switch.

In accordance with another feature of the present invention, the pump comprises a pump housing having a center axis, and a curved wall section having an inwardly facing generally circular curved pressure surface centered on said center axis. There is a compressible pump tube having an inlet portion, an outlet portion, and an intermediate portion extending along the circularly curved pressure surface.

There is a center drive gear mounted at the center axis. A plurality of pump gears are positioned around and mesh with the drive gear. The pump gears are arranged to travel in a circular path around the center axis in response to rotation of the drive gear and to exert an outward force to compress the pump tube along its length to cause a pumping action of the tube. There is a gear mounting frame to which the pump gears are rotatably mounted. The gear mounting frame is rotatably mounted to fixed structure so as to be maintained for rotation about said center axis, so as to maintain the pump gears in a proper radially spaced relationship from the center axis and to react forces on the pump gears directly into the gear mounting members, while substantially alleviating any lateral loading into the center drive gear.

In the preferred form, there is a circumferential flexible band extending around the pump gears, with the belt being positioned between the pump gears and the pump tube. Thus, pressure from the pump gears is transmitted through the band to the pump tube. Also, in the preferred form, there is an intermediate gear connected to the center drive gear and centered at the center axis. The system further comprises a rotary pump motor having an axis of rotation spaced from the center axis. The motor has an output shaft operatively engaging the intermediate gear to drive the drive gear. Preferrably, the intermediate gear and the drive gear are mounted to a shaft positioned at the center axis. The shaft is anchored to stationary structure at opposite ends thereof, and the gear mounting frame is rotatably mounted to the shaft.

In the preferred form, the overall configuration of the supply section is such that it comprises a horizontally extending first housing section providing a horizontal platform to support a paint container at a paint containing area. There is a vertically aligned second housing section connected to the first housing section and extending upwardly therefrom. The second housing section is spaced laterally from the containing area. The pump motor has a vertical axis of rotation and is positioned in the second housing section. The pump motor has an output shaft extending downwardly from the motor and rotatable about a pump axis of rotation. Drive gear means, including the drive gear, is operatively connected to the output shaft.

In the preferred form, the second housing section has a lower generally circular portion enclosing the pump tube. The pump tube has inlet and outlet ends located in the first housing section, and an intermediate portion extending in a generally circular path around the lower portion of the second housing section.

In accordance with another feature of the present invention, the applicator comprises a housing structure defining a plenum to receive paint from the delivery and control section. Further, there is a discharge portion mounted to the housing structure and having a discharge surface with a discharge area to which the paint is discharged. The discharge area comprises a plurality of discharge zones.

The housing structure further defines a plurality of distribution passageways, each of which leads from said plenum to a related discharge zone. The passageways are characterized in that the passageways have substantially similar length and cross-sectional configuration, whereby flow of paint through the passageways is substantially uniform to the discharge zones.

In the preferred form, the housing structure has a lengthwise axis, and the plenum is substantially centered relative to the lengthwise axis. The passageways extend from the plenum toward opposite ends of the discharge portion. Specifically, the passageways comprise a plurality of larger trunk passageways leading from the plenum, and a plurality of sets of branch passageways, with each set leading from a related pump passageway. Thus, paint is distributed from the plenum first through the trunk passageways, and then through the branch passageways to the discharge zones. In the specific form shown herein, the trunk passageways extend in opposite directions toward end portions of the discharge portion, and each set of branch passageways extends oppositely from its related trunk passageway.

In one embodiment, the discharge portion comprises a cover member having a generally circular configuration and rotatably mounted around said housing structure. The housing structure then has circumferential lip members forming discharge zones spaced axially along the lengthwise axis of the discharge cover. In another form, the discharge portion comprises a substantially planar pad, and the housing structure comprises wall means defining the discharge zones.

Yet another feature of the present invention is that the housing structure comprises three housing sections, namely first and second housing sections which are adapted to fit one against the other, and a third housing section surrounding the first and second housing sections. The first and second housing sections have matching wall members cooperating to define the plenum and the distribution passageways. The third housing section has a generally cylindrical configuration and supports the discharge portion of the applicator.

Desirably, the third housing section is provided with interior slideway means, and the first and second housing sections can be placed together and slid into engagement with the slideway means within the third housing section. The applicator further comprises a feed tube to which the housing structure is mounted. There is a mounting adaptor adapted to be mounted to the feed tube. The first and second housing sections have matching recesses to fit against the mounting adaptor so as to be in locking engagement with the mounting adaptor.

As a specific improvement, the first and second housing sections have at one end portion thereof notch means. The third housing section is formed so as to expose the notch means and provides a bearing surface. Thus, by applying a tool in the notch means and against the bearing surface, the first and second housing sections can be slid outwardly from said third housing section.

In accordance with another facet of the present invention, the supply section is provided with a lid to close a paint container. The lid has a tube receiving structure defining a through opening to receive a feed tube to withdraw paint from the paint container and deliver the paint to the pump. The tube receiving structure is adapted to interfit with a discharge end fitting of the delivery and control section. Thus, paint that is pumped through the delivery and control section can be returned to the paint container.

In the method of the present invention, a system is provided such as described above. The paint is delivered under pressure through the delivery tube to the applicator. The pressurizing switch is operated to increase and decrease pressure in the actuating tube to cause the pump to operate or not operate, and thus control flow of the liquid, which in the preferred form is paint. Desirably, this is accomplished by providing a compressible tube section that communicates with ambient atmosphere. The pressurizing member is moved from its release position on a path to first close the compressible tube section and then move further relative to the tube section to compress the tube section and thus pressurize the passageway of the actuating tube. Opposite movement of the pressurizing member releases pressure in the passageway and thus turns off the motor.

Also, in the method of the present invention, the paint that is to be applied is directed into a plenum, and then through a passageway system, where the passageways are similar to one another relative to length and cross-sectional area. The passageways in turn lead to distribution zones where the liquid (in the preferred form, paint) is distributed in a uniform manner from the applicator.

Other features will become apparent from the following detailed description.

DESCRIPTION OF THE PREFERRED EMBODIMENTS

Figure 1:
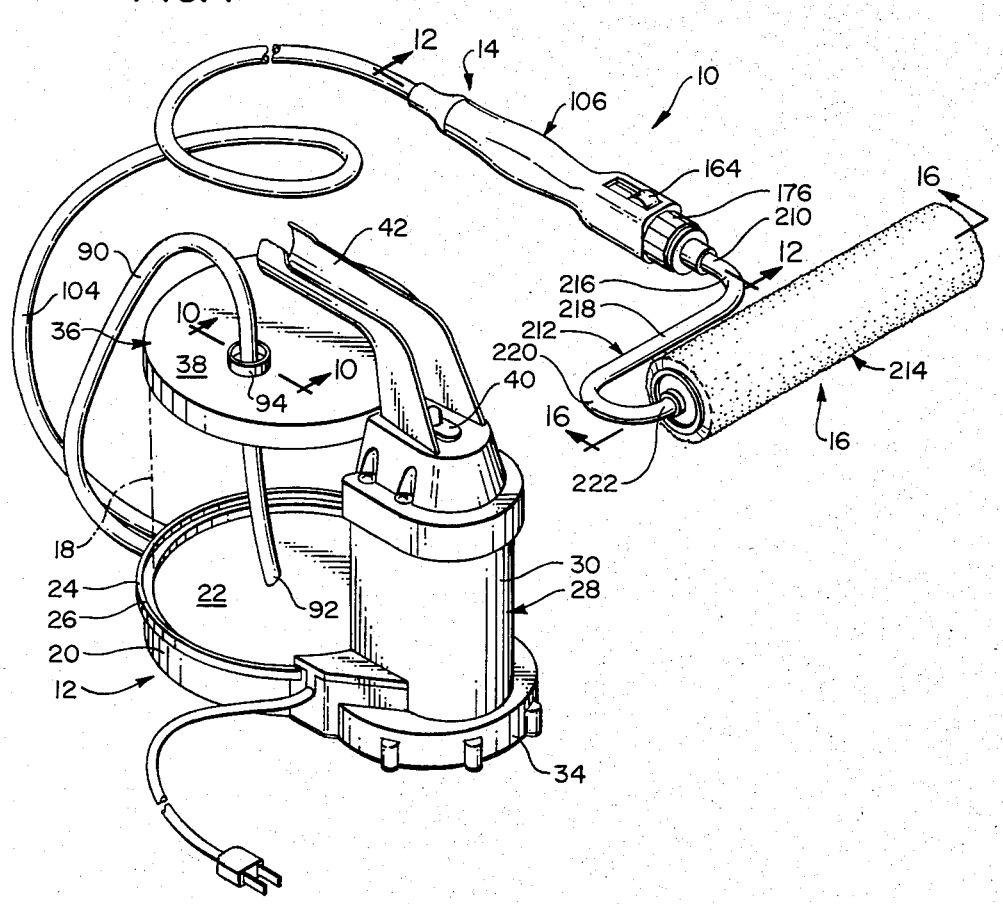
FIG. 1 is an isometric view showing the apparatus of the present invention.

The apparatus 10 of the present invention has three main components, namely a supply section 12, a delivery and control section 14, and an applicator section 16.

The supply section 12 functions generally to carry a paint container (e.g. a gallon paint can indicated in broken lines at 18 in FIGS. 1 and 2) and to deliver this paint under power through the delivery and control section 14 and to the applicator 16. This supply section 12 comprises a lower housing 20 having the shape of a shallow cylinder. The circular top wall 22 of the housing 20 has a peripheral circular lip 24 to position the lower end of the paint can 18. The upper edge of the lip 24 can be stepped outwardly as at 26 to catch small amounts of paint which possibly could drip down the side of the can.

There is a second upright housing section 28, the upper part 30 of which contains a vertically aligned electric motor 32. The lower part 34 of the housing 28 comprises a pump housing. Removably connected to the top wall of the upper housing section 30 is a lid 36. This lid 36 has a main circular lid portion 38 which fits onto the top edge of the paint can 18. The lid 36 has a mounting bracket 40 which extends over and connects removably to the upper housing section 30.

Figure 2:
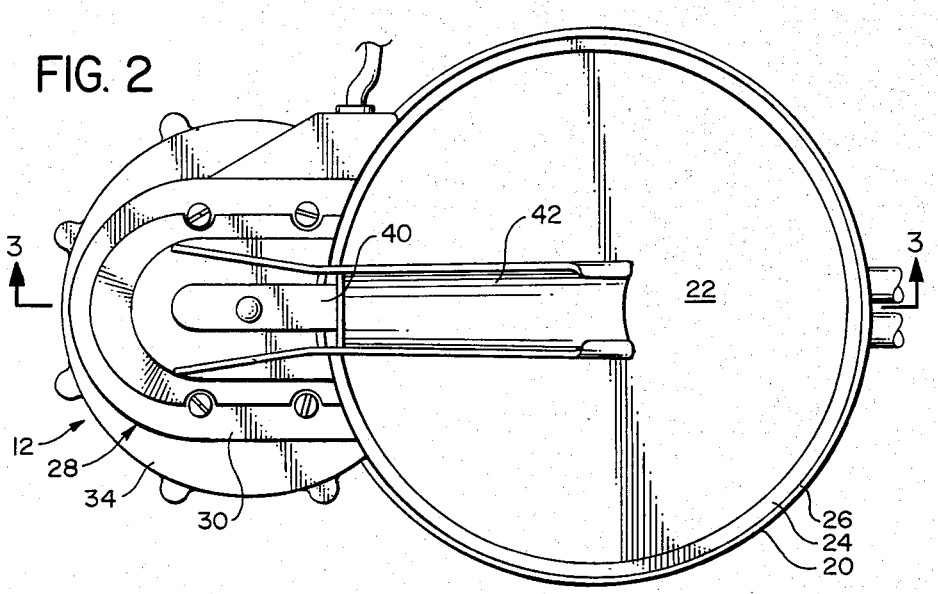
FIG. 2 is a top plan view of the supply section of the present invention.
Figure 3:
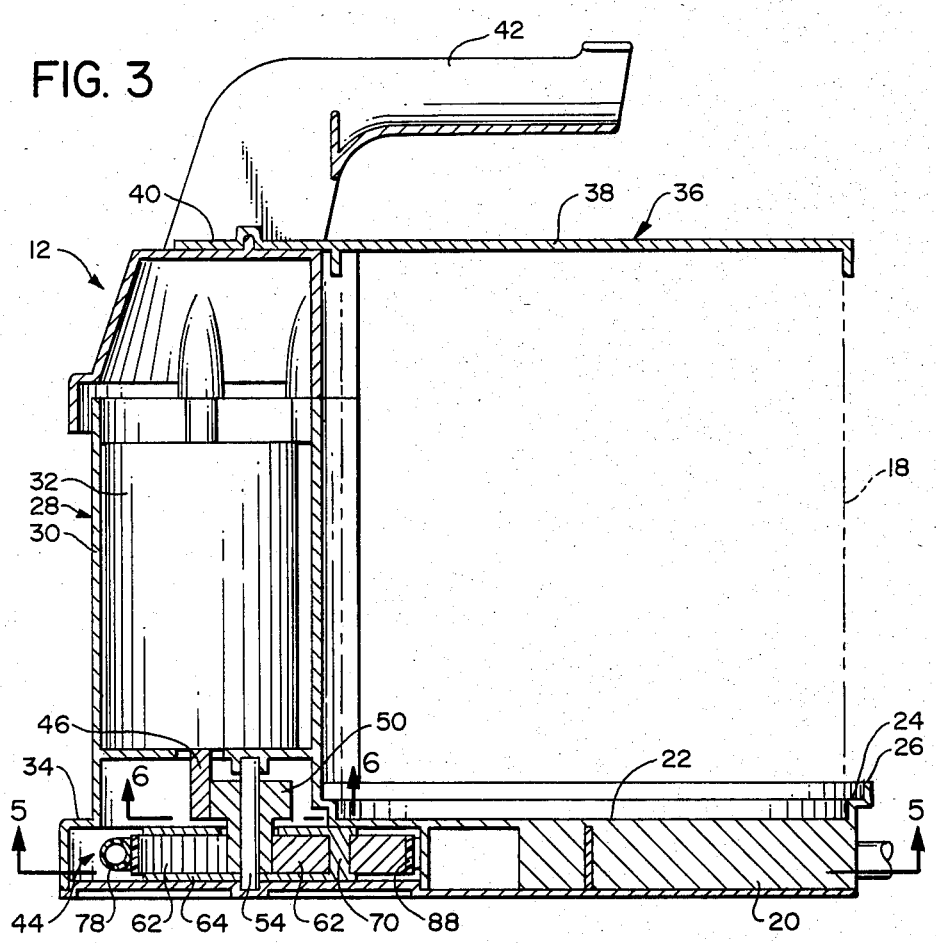
FIG. 3 is a vertical sectional view taken along line 3—3 of FIG. 2.

A carrying handle 42 is connected to the top wall of the upper housing section 30, and this handle 42 extends over the location of the lid portion 38. As can be seen in FIG. 1 and FIG. 3, a paint can 18 can be placed on the platform provided by the wall 22 of the lower housing 20, and then the lid 36 can be placed over the can 18 to close the top end thereof.

Figure 4:
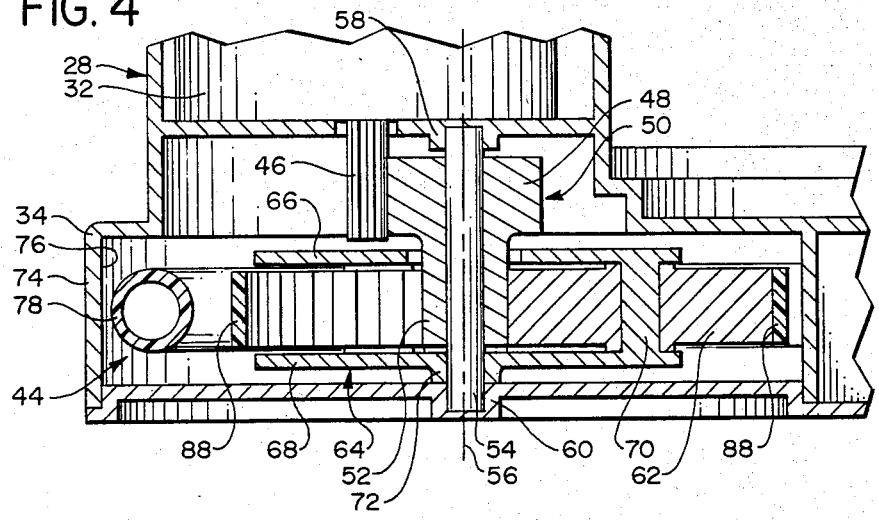
FIG. 4 is a sectional view taken along the same plane as FIG. 3, but showing the pump portion of the supply section to an enlarged scale.
Figure 6:
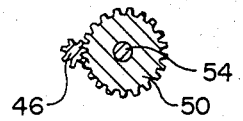
FIG. 6 is a horizontal sectional view taken along line 6—6 of FIG. 3.
Figure 5:
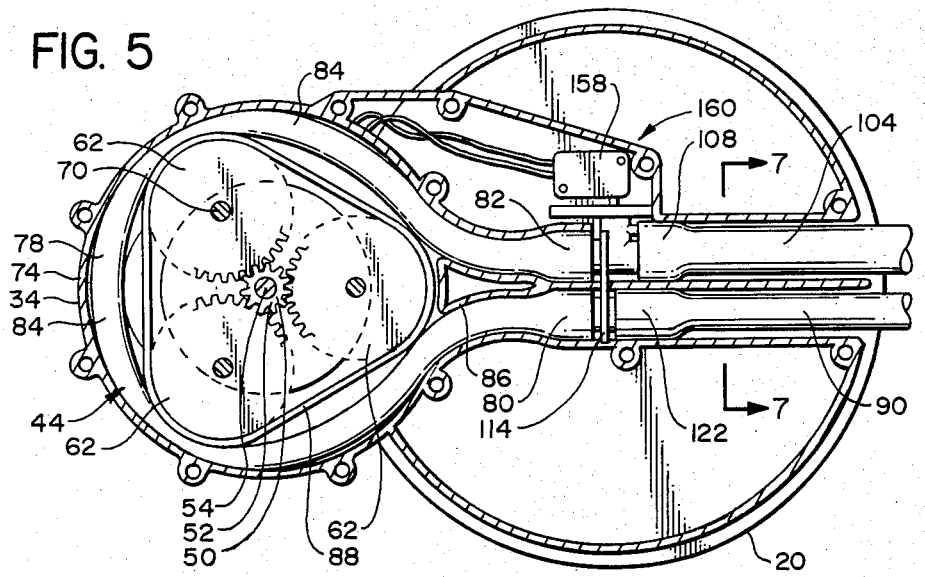
FIG. 5 is a horizontal sectional view taken along line 5—5 of FIG. 3 and looking upwardly into the supply section.

The pumping system of the present invention is generally designated 44, and this will now be described with reference to FIGS. 4–6. The electric motor 32 has at its lower end a downwardly extending drive shaft 46 formed with grooves to mesh with a upper gear portion 48 of a drive gear 50, with the drive gear 50 having a lower drive gear output portion 52. This drive gear 50 is rotatably mounted around a center, vertically aligned bearing shaft 54 which is fixedly located about its vertical center lengthwise axis 56 by its upper end in a wall 58 and its lower end in a lower wall 60.

The pumping system 44 further comprises three pump gears 62 which mesh with and are arranged symmetrically around the output drive gear 52. These pump gears 62 are mounted for rotation about their center axes to a mounting frame 64 made up of upper and lower circular plates 66 and 68, respectively. Specifically, each gear 62 is mounted to a respective pin or shaft 70, each of which is rigidly connected to and extends between the plates 66 and 68. The lower plate 68 has an inner bearing member 72 which fits rotatably against and around the lower end of the main bearing shaft 54. Thus, lateral loads imposed upon one or more of the pump gears 62 are transmitted through the pins 70 into the mounting frame 64 with the mounting frame bearing member 72 then transmitting the loads to the shaft 54.

The pump housing section 34 has a generally circular sidewall 74 which provides an inner circular wall surface 76. There is a flexible pump tube 78 which has an inlet end 80, an outlet end 82, and an intermediate pumping portion 84. The intermediate pumping portion 84 is positioned in a circular configuration against the circular wall surface 76. A contoured member is provided at 86 to form a smooth curved transition from the intermediate portion 84 to the inlet and outlet ends 80 and 82.

A circumferential flexible band or belt 88 extends around the three pump gears 62. The pump components described above are sized so that with the band or belt 88 positioned around the gears 62, the intermediate tube portion 84 is substantially totally closed off at the location where each pump gear 62 is immediately adjacent that part of the tube portion 84.

To describe briefly the operation of the pumping system 44, the motor shaft 46 and the drive gear 50 comprise a speed reducing gear drive. The rotation of the drive gear output 52 (which rotation is clockwise as seen in FIG. 5) causes corresponding rotation of the three pump gears 62. The frictional engagement of the pump gears 62 with the peripheral band or belt 88 causes the three pump gears 62 to travel in a circular pattern (clockwise as shown in FIG. 5). It can readily be seen that as each gear 62 moves by the contoured fitting 86, that pump gear 62 engages the inlet end part of the intermediate tube portion 84 so as to close off the intermediate portion 84, thus entrapping that portion of the paint which is circumferentially forward of that pump gear 62. As the pump gears 62 continue to travel in a circular path, the paint that is entrapped between each pair of gears 62 is moved in a circular path from the inlet end of the intermediate tube portion 84 toward the outlet end, thus creating a suction at the inlet 80, and outlet pressure at the outlet 82.

Since the pumping action results from a compressive force exerted by the gears 62 against the band 88 and thence against the intermediate tube portion 84, lateral loads will be exerted through the pump gears 62. However, as noted above, such lateral loads would be reacted directly into the main drive shaft 54. Thus, even though the center drive gear portion 52 is in driving engagement with the gears 62, there is substantially no lateral loading on the relatively small drive gear 50. Rather, the lateral loading is reacted directly from the mounting frame 64 into the shaft 54. Another benefit of this system is that a relatively high speed motor (and hence a relatively smaller motor) can be used in conjunction with a compact gear reduction system with a minimum of operating parts. Further, the gear system enables the proper action of the pump to be achieved, while maintaining proper pitch clearance to prevent gear wear.

There is a pump inlet tube 90 to draw paint from the can 18 and deliver it to the pump tube inlet 80. The inlet end portion 92 of this tube 90 is inserted through an inlet fitting 94 formed in the lid 36. This inlet fitting has a circular opening 96 defined by a moderately sharp inwardly extending peripheral edge 98. This edge 98 insures proper frictional engagement with the tube 90.

In addition, the fitting 94 is provided with an upstanding annular flange 100, the upper edge of which is formed with an inwardly protruding peripheral edge 102. As will be described more fully hereinafter, the purpose of this flange 100 is to provide a connection for returning paint from the system back to the paint can 18. The inlet tube 90 extends from the lid 36 downwardly and into the forward end of the lower housing portion 20 to connect to the aforementioned pump 80.

To turn our attention now to the delivery and control section 14, this delivery and control section 14 comprises generally a flexible delivery tube 104 and a control handle 106 at the outlet end of the delivery and control tube 104. The inlet end 108 of the delivery and control tube 104 connects to the outlet tube end 82 of the pumping system 44.

To accomplish the control function of the delivery and control section 14, the delivery and control tube 104 is in the form of a Siamese tube and is thus formed with a main passageway 110 to carry the paint, and also with a quite small air passageway 112. As will be described more fully later herein, this air passageway 112 is selectively pressurized to activate a power switch to cause the motor 32 to power the pump system 44 and deliver paint to the tube 104.

Figure 8:
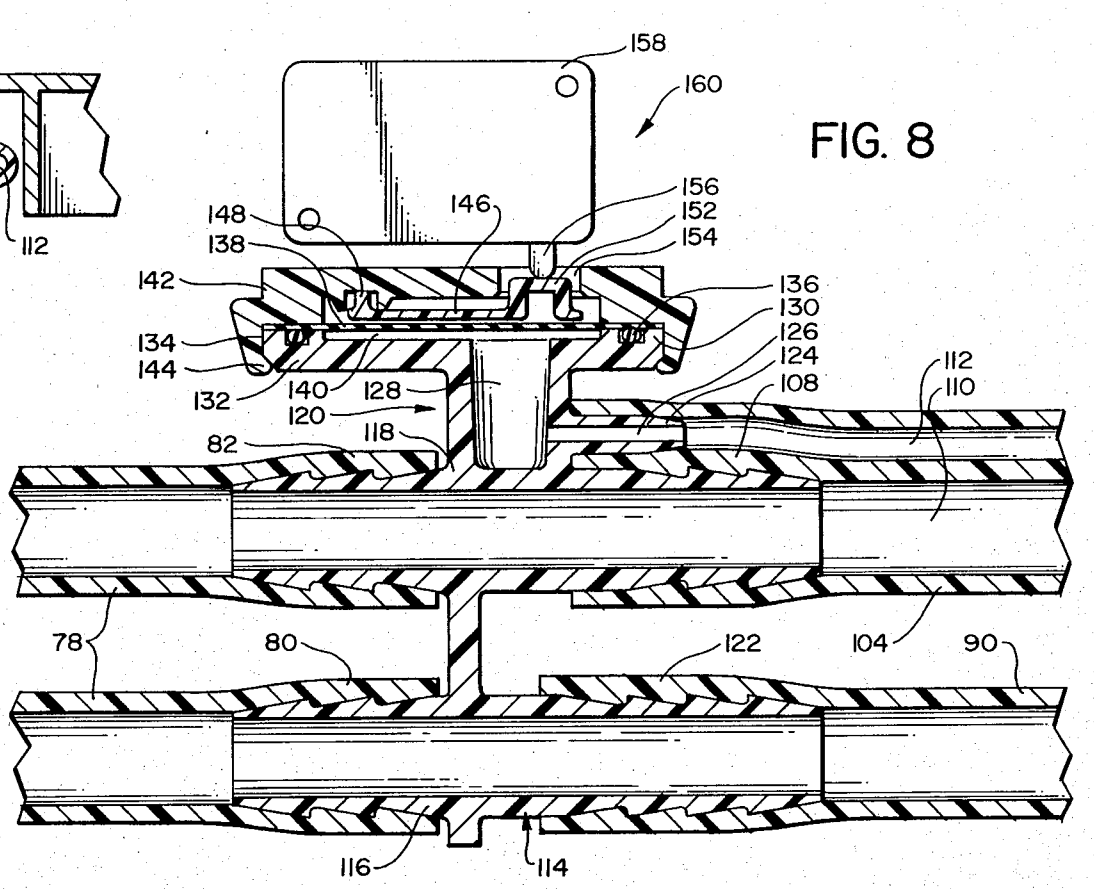
FIG. 8 is a sectional view, showing the connection between the intake and outtake lines for the pump, and also showing the pressure responsive switch of the present invention, with the section being taken along a plane coinciding with the lengthwise axes of the inlet and outlet tubes.
Figure 7:
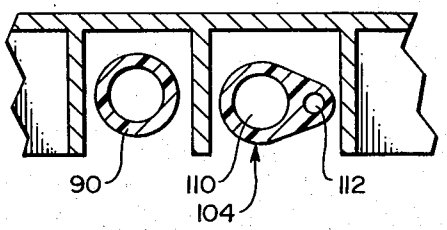
FIG. 7 is a sectional view taken along line 7—7 of FIG. 5.

Reference is now made to FIG. 8, which shows to an enlarged scale the interface section between the delivery and control tube 104 and the supply section 12. There is provided a molded plastic fitting 114 having two tubular portions 116 and 118, respectively, and a control switch portion 120. One end of the first tubular portion 116 fits into the pump tube inlet 80, and the other end of the tubular portion 116 fits into the outlet end 122 of the supply tube 90. The other tubular portion 118 has one of its ends fitting into the pump tube outlet 82, and the other end fitting into that portion of the delivery and control tube inlet 108 that defines the paint passageway 110.

The control switch portion is formed with a nipple 124 that fits into that part of the delivery and control tube end portion 108 that forms the air passageway 112. The interior passageway 126 provided by the nipple 124 leads into a pressure chamber 128 formed in the base of a T-shaped portion 130 of the fitting 114. This portion 130 has a flat plate 132 having an outwardly facing peripheral lip 134 formed with a groove to accommodate an O-ring seal 136. A flexible diaphragm 138 extends across the peripheral lip 134 so as to define a very shallow chamber portion 140 that communicates with the aforementioned pressure chamber 128.

To secure the diaphragm 138 to the plate 132, there is provided a plate member 142 having a peripheral lip 144 which snaps over the plate member 132. Thus, the two plate members 142 and 132 grip the entire periphery of the diaphragm 138 so as to provide a closed chamber made up of the aforementioned chamber 128 and the rather shallow chamber portion 140 adjacent the diaphragm 138. These chambers 128–140 communicate directly with the passageway 126 that in turn communicates with the air passageway 112.

Mounted in the plate 142 adjacent the diaphragm 138 is a switch arm 146 which has a first pivot end 148 that fits in a matching recess in the plate 142, and a second actuating end 152. The actuating end 152 protrudes outwardly through an opening 154 in the plate 142 and engages a depressible actuating pin 156 for a power switch 158. By depressing the pin 156, the switch 158 is closed to deliver power to the motor 32 and cause the pumping system 44 to operate.

The components described above and designated by numerals 120–158 collectively comprise a pressure responsive switch 160. To describe briefly the operation of the switch, the chambers 128 and 140 are closed, except for the communication through the nipple passageway 126 and to the pressure passageway 112. Further, that surface of the diaphragm 138 that is adjacent the arm 146 is exposed to ambient atmosphere. When there is an increase in pressure in the passageway 112, the diaphragm 138 is pushed outwardly to cause the actuating end 152 of the arm 146 to swing upwardly and depress the pin 156 of the switch 158. As indicated above, this causes the motor 32 to operate and cause the pumping system 44 to operate. The pivoting action of the arm 146, with the diaphragm 138 acting against a middle portion of the arm 146, causes a relatively long path of travel of the actuating end 152. Thus, the actuating pin 156 of the switch 158 does not have to be particularly sensitive to its precise position relative to the "on/off" location.

The pressurization of the passageway 112 with the consequent closing of the pressure responsive switch 160 is accomplished through the control handle 106, which will now be described with reference to FIGS.

12 and 13. The control handle 106 has a rear handgrip portion 162 which is shaped to be conveniently grasped in the fingers and palm of a person's hand. Just forward of the handgrip portion 162 is a pressure control member in the form of a roller 164. This roller 164 is positioned so that it can conveniently be manipulated by the thumb of the person's hand that is grasping the grip portion 162.

Figure 12:
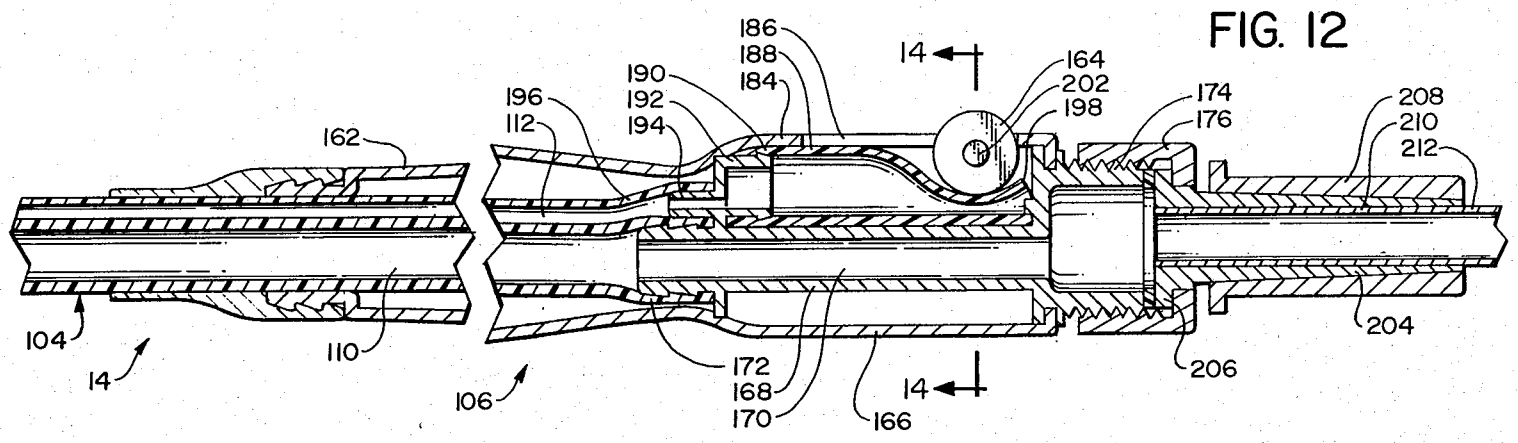
FIG. 12 is a sectional view taken along line 12—12 of FIG. 1, and illustrating the control handle at the outlet end of the delivery section, and with the pressurizing switch in its release position.

With further reference to FIG. 12, it can be seen that the control handle 106 comprises a forward housing portion 166 that has a cylindrical portion 168 defining a through passageway 170 through which paint can flow. The rear end of the cylindrical portion 168 fits into the outlet end 172 of that portion of the delivery tube 104 that defines the paint passageway 110. The passageway 170 leads into a threaded fitting 174 that is integral with the cylindrical portion 168 and onto which is threaded a retaining nut 176. The cylindrical portion 168 and threaded fitting 174 provide for the flow of paint to the applicator 16.

The housing 166 has an upper elongate housing portion 178 that has an essentially rectangular cross-sectional configuration. More specifically, there is a lower wall 180, two side walls 182, and a top wall 184. The top wall 184 is formed with an elongate slot 186 to accommodate the aforementioned control roller 164.

Positioned in and extending along the length of the housing portion 178 is a flexible tube 188. The rear end 190 of the tube 188 fits over one end of a fitting 192, the rear end 194 of which extends into the front end portion 196 of that part of the delivery and control tube 104 that defines the pressure passageway 112. Thus, the pressure passageway 112 communicates through the fitting 192 with the interior of the flexible tube 188. With the tube 188 in its unflexed condition, the cross-sectional area of the tube 188 is many times greater than the cross-sectional area of the air passageway 112. When the roller 164 is at its forward position of FIG. 12, the front end 198 of the tube 188 is open to ambient atmosphere.

Figure 14:
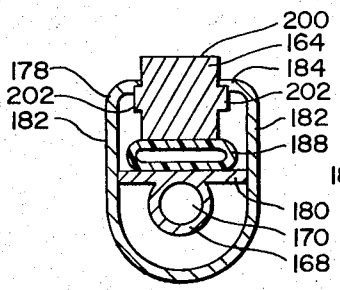
FIG. 14 is a sectional view taken along line 14—14 of FIG. 12.

The aforementioned control roller 164 has a generally cylindrical configuration, and thus has an outer cylindrical surface 200. The two flat end faces of the roller 164 are provided with two circular trunnion-like protrusions 202 that engage the inside surfaces of the edge portions that define the aforementioned slot 186. The roller 164 is arranged relative to the slot 186 so that when the roller 164 is in the forward release position as shown in FIG. 12 (and also shown in FIG. 14) the trunnions 202 fit into two detents 203 so that the cylindrical sidewall 200 is raised moderately from the tube 188 so that the interior of the tube 188 opens to atmosphere through the front end 198 of the tube 188.

However, when the roller 164 is moved rearwardly, the edges defining the slot 186 lower the control roller 164 so that it bears downwardly against the tube 188 and closes the tube 188 from its end portion 198 that is open to ambient atmosphere.

To describe how the control handle 106 operates, when the control roller 164 is in the forward position of FIG. 12, the front end lip portion 198 of the tube 188 is open to ambient atmosphere. In this condition, the interior of the tube 188, and consequently the air passageway 112 are at ambient atmosphere, and the pressure responsive switch 160 remains in its open position as shown in FIG. 8. In that position, the motor 32 is stationary and there is no pumping action to deliver any paint to the applicator 16.

Figure 9:
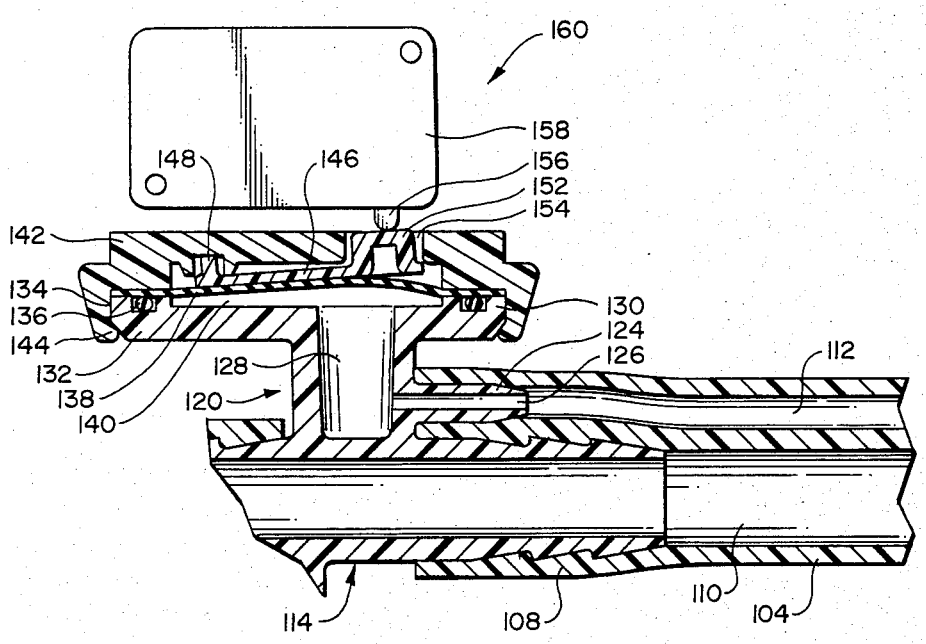
FIG. 9 is a sectional view taken along the same plane as FIG. 8, and showing the pressure responsive switch in its "on" position.

When the control roller 164 is rolled rearwardly, at the very initial rearward movement, the roller 164 moves out of the detents 203 and thus downwardly to pinch off the front end of the tube 188, thus closing the interior of the tube 188 from ambient atmosphere. As the roller 164 continues to be rolled rearwardly, the engagement of the trunnion-like portions 202 of the roller 164 engaging the side edges of the slot 186 causes the roller 164 to continue pinching the tube 188 closed, and also reduces the volume of the tube 188 so as to pressurize the air passageway 112. This increase in pressure along the entire length of the air passageway 112 causes the pressure responsive switch 160 to move to the closed position of FIG. 9 and thus cause the motor 32 to operate and cause the pumping system 44 to deliver paint through the passageway 110. As long as the roller remains in the position of FIG. 13, the pumping system 44 will continue to operate, and paint will continue to be delivered.

Figure 13:
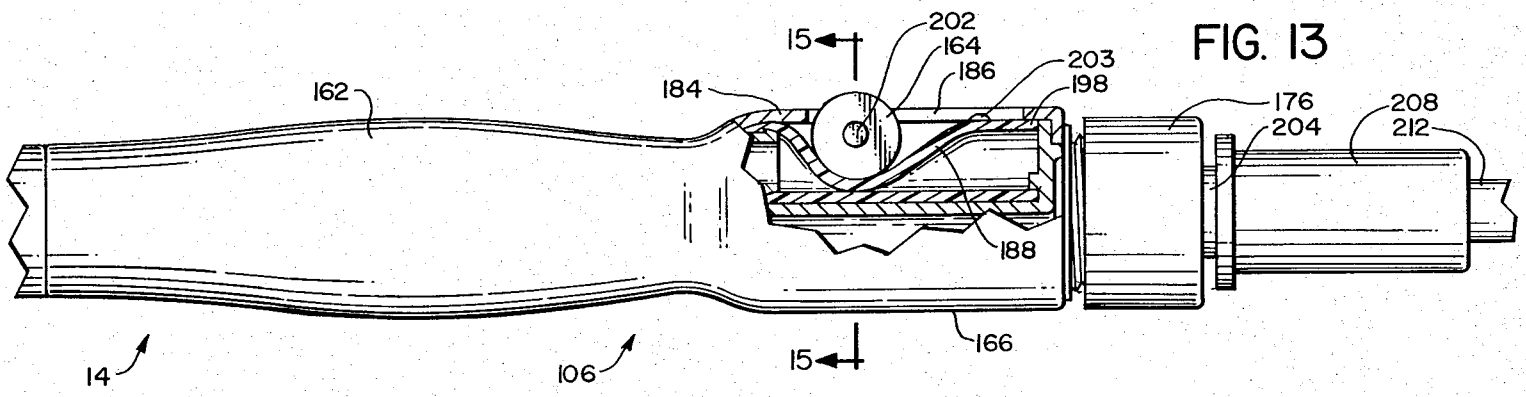
FIG. 13 is a view similar to FIG. 12, but showing the delivery handle mostly in side elevation, with the pressurizing switch being shown in section at its pressurizing location.

There is sufficient friction between the roller 164 and the tube 188 so that once the roller 164 is moved to its "on" position, as in FIG. 13, it will remain in that position until it is positively engaged (e.g. by the person's thumb) to be moved forward again. Obviously, as an alternative, the roller 164 could be provided with means to urge it continuously toward its forward "off" position. In that case, paint would continue to be delivered to the applicator 16 only when the roller 164 was positively held in its "on" position. However, holding the roller 164 in the "on" position can be tiring, and the present configuration is preferred. When the roller 164 is moved forward, it immediately begins reducing pressure in the passageway 112 and thus insures a prompt opening of the switch 160.

The forward end of the control handle 106 is provided with suitable fittings so that the handle 106 can be connected to the applicator 16. Specifically, there is an elongate forwardly extending tapered sleeve 204, having a rear flange 206 which is engaged by the inwardly protruding lip of the retaining nut 176. There is a second retaining sleeve 208 fitting around the sleeve 204 and having a moderate taper opposite to that of the sleeve 204. Thus, by pressing the outer sleeve 208 rearwardly onto the inner sleeve 204, the sleeve 204 can be compressed inwardly to grip an inner end portion 210 of a metal feed tube 212 of the applicator 16.

To comment briefly on some of the advantages of the system noted above, to prevent clogging in a paint system (especially where dried paint can become a problem), it is desirable that the flow passage for the paint be relatively unobstructed. Since the present control system has no valving which operates on the paint directly, this potential clogging problem is substantially alleviated. With regard to the air pressurizing switching system described above, when there is a change of weather or shipment to higher or lower elevations, the pressure of the ambient atmosphere could change substantially. Since the roller 164 moving to its "off" position opens the passageway 112 to ambient atmosphere, this problem is alleviated.

The applicator 16 comprises generally the aforementioned feed tube 212, and in this first embodiment, a roller assembly 214. As can be seen in FIG. 1, the feed tube 212 has a conventional configuration and comprises the aforementioned rearwardly extending mounting portion 210, which is connected by a right angle curved portion 216 to a laterally extending tube portion 218, which is in turn connected to a 180° curved portion 220. The curved portion 220 in turn connects with an outlet end portion 222 to which the roller assembly 214 is mounted.

The roller assembly comprises a manifold housing 224 which is made in three sections, namely two identical inner housing sections 226 and an outer generally cylindrical section 228. Surrounding the manifold housing 224 is a cylindrical discharge roller cover 230 which is rotatably mounted around the housing 224 by means of two end bearings 232 and 234.

Figure 16:
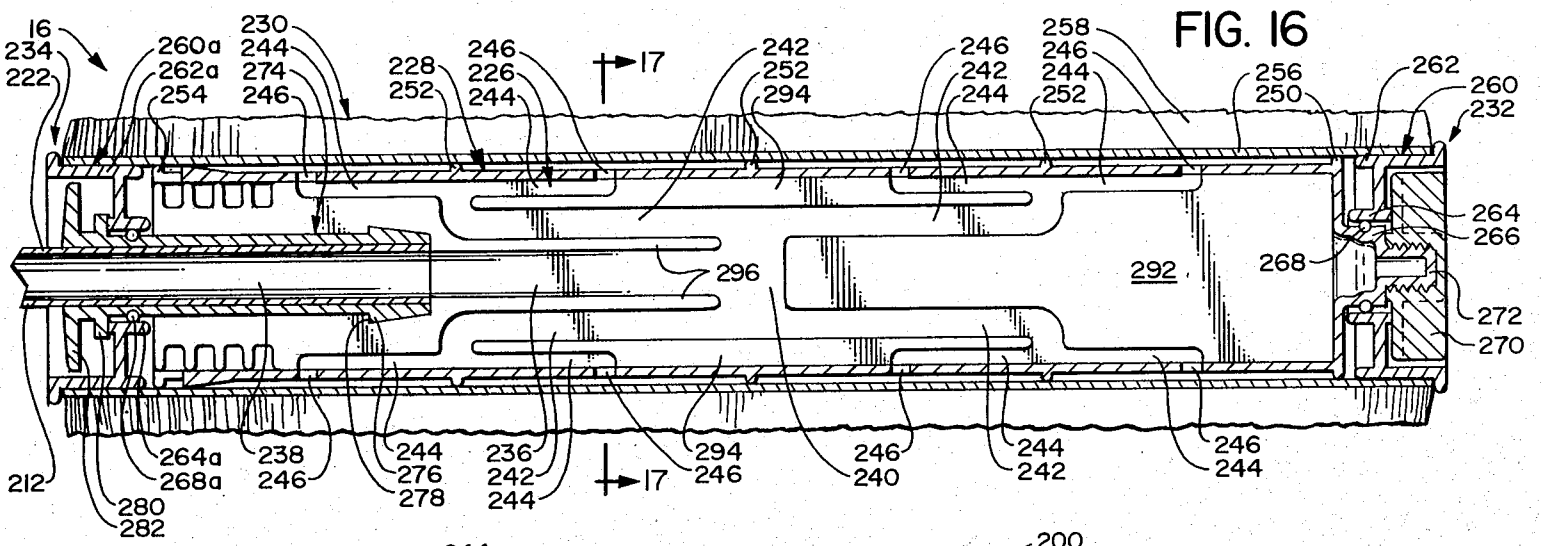
FIG. 16 is a sectional view taken along line 16—16 of FIG. 1, with the section line being coincident with a lengthwise axis of the pressure section.
Figure 15:
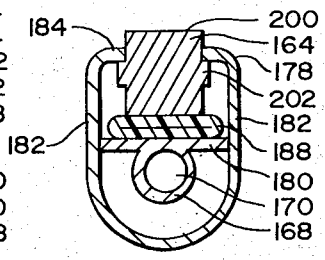
FIG. 15 is a sectional view taken along line 15—15 of FIG. 13.
Figure 17:
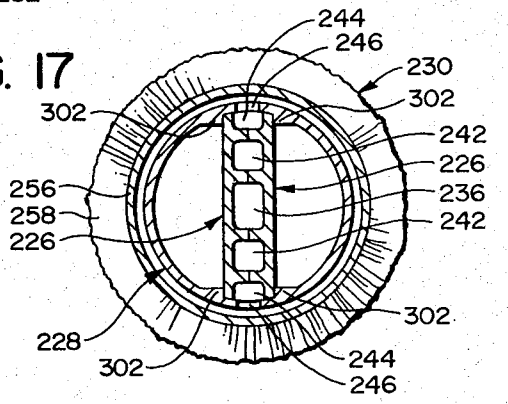
FIG. 17 is a sectional view taken along line 17—17 of FIG. 16.

The construction of the manifold housing 224 is significant in the present invention, and will first be described in more functional terms, after which the specific construction will be described in more detail. In FIG. 16, the housing 224 can be seen to comprise a center plenum 236 which connects to the feed passageway 238 defined by the outlet end 222 of the feed tube 212. The plenum 236 extends from the feed passageway 238 to a central location at 240, from which the plenum 236 branches outwardly in two directions 180° diametrically opposed to one another, each into two laterally extending trunk passageways 242. The two trunk passageways 242 of each set are positioned on opposite sides of the plenum section 240 and extend parallel to the axial centerline of the roller assembly 214. Each trunk passageway 242 extends toward a related end portion of the assembly 214 and then in turn branches into a pair of oppositely extending branch passageways 244. These branch passageways 244 are also parallel to the axial centerline of the roller assembly 214 and are proximate to the outer cylindrical housing section 228. Each of the eight branch passageways 244 terminate in a related discharge opening 246. Thus, the overall arrangement is such that there are four exit openings 246 on one side of the manifold housing 224 and four more on the opposite side, with each of set of four openings 246 being substantially evenly placed along the length of the manifold housing 224. With reference to FIG. 17, it can be seen that the cross-sectional area of the plenum 236 is greater than that of each of the trunk passageways 242, each of which is in turn greater than the cross-sectional area of the branch passageways 244.

Before describing in more detail the structure of the roller assembly 214, it is believed that the novel features of the present invention will be better appreciated by describing generally the operating characteristics of the manifold housing 224. For proper operation of the applicator 16, it is necessary that the paint be distributed substantially uniformly over the entire discharge surface of the discharge roller cover 230. To see how this is accomplished in the present invention, let us examine the flow of the paint through the feed tube 38 and through the passageways 242 and 244 to the openings 246.

At the outlet end 240 of the plenum 236, obviously the paint flowing outwardly into the two sets of trunk passageways 242 is of substantially the same uniform pressure and velocity. Likewise, with each of the four trunk passageways 242 being of substantially identical length and configuration, the velocity and pressure of the paint flowing through these trunk passageways 242 would be substantially the same. Finally, as the paint exits into the eight branch passageways 244, with each of the branch passageways 244 being of substantially the same configuration and length, the flow in each passageway 244 remains uniform. Thus, it becomes apparent that the flow through the openings 246, which are uniformly spaced along the length of the manifold housing 224, is substantially uniform.

Obviously, within the broader scope of the present invention, the arrangement of trunk and branch passageways 242 and 244 could be arranged so that there could be a greater or lesser number of discharge openings (such as at 246) all of which receive paint at substantially the same discharge velocity and pressure. However, it has been found that the arrangement shown in FIG. 17 has proved to be quite satisfactory in providing an even and uniform flow of paint throughout the entire length of the roller assembly 214.

The outer cylindrical surface 229 of the manifold housing 224 is provided with five circumferential lips or annular flanges, namely an end flange 250, three intermediate flanges 252, and an opposite end flange 254. The three intermediate flanges 252 are each spaced proximate equi-distant from a related pair of discharge openings 246.

The aforementioned roller cover comprises a base fabric or substrate 256 to which is mounted a cylindrical polyester layer 258. Alternatively, the polyester layer 258 could be made of other material, such as a pad-like material or a brush-like material, provided it has the capability of retaining paint in the layer 258. The peripheral flanges space the base fabric or substrate 256 a slight distance away from the outer manifold surface 229 to permit the paint being discharged from the openings 246 to become distributed around the entire surface 229 of the manifold housing 224.

The aforementioned end bearing 232 comprises a rotatable bearing member 260 having an outer cylindrical portion 262 to engage a related end portion of the roller cover 230, and an inner portion 264 which engages a protruding end portion 266 of the manifold 224. An O-ring seal 268 is provided between the members 264 and 266. To retain the rotatable bearing member 260, there is provided a threaded end cap 270 that fits on a threaded end portion 272 of the member 266.

The opposite end bearing 234 has an end bearing member 260*a* substantially similar to the other bearing member 260. Thus, it has an outer cylindrical portion 262*a* to engage its related end portion of the roller cover 230 and an inner bearing portion 264*a* which engages a related O-ring seal 268*a*.

There is a mounting adaptor 274 that fits around the outlet end 222 of the feed tube 212. This adaptor 274 has a generally circular configuration, and has a forward moderately flared portion 276 which provides an annular step 278 which functions to hold the adaptor 274 securely in place within the manifold housing 224. At the opposite end of the adaptor 274, there are a pair of flanges, namely an inner flange 280 to retain the bearing member 260*a*, and a larger outer flange 282 which closes the space within the outer portion of the bearing member 260*a*.

Figure 18:
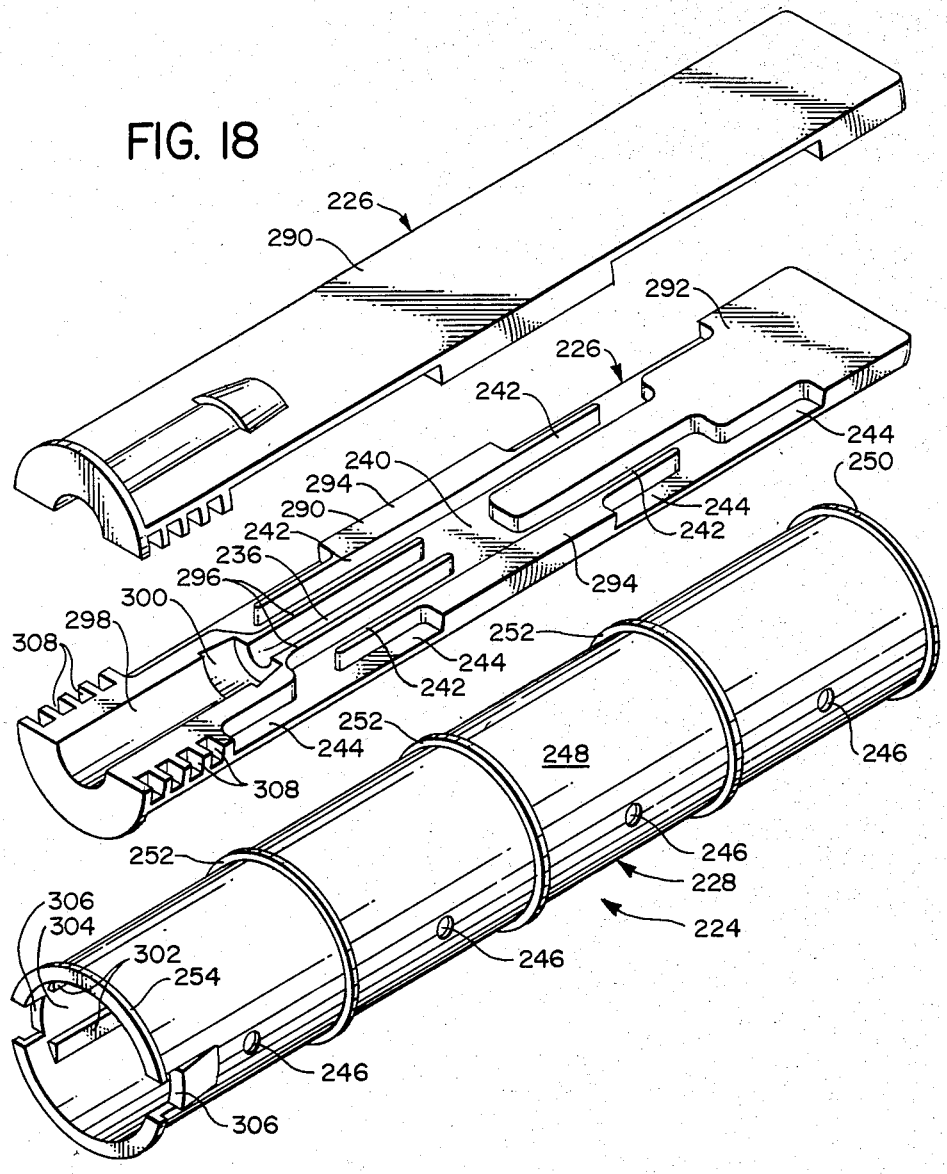
FIG. 18 is an exploded isometric view illustrating three sections of the housing of the applicator section.

As indicated previously, the manifold housing 224 is conveniently made up of two inner sections 226 and an outer cylindrical section 228, these being shown more clearly in FIG. 18. Each of the inner sections 226 has a main plate member 290, having an inwardly facing surface formed with a plurality of raised portions. More specifically, there is an end raised portion 292 proximate the end bearing 232, and this portion 292 cooperates with the mating portion 292 of the other section 226 to form walls for two of the trunk passageways 242 and two of the branch passageways 244. At the center portion of each inner section 226, there are two other protruding members 294 which further define the four trunk passageways 242 and four of the branch passageways 244. A pair of flange members 296 define not only the central plenum 236, but also two of the trunk passageways 242. The mounting end of each section 226 is formed so as to define one half of a cylindrical recess 298 which receives the aforementioned mounting adaptor 274. The forward end of the recess 298 is flared outwardly as at 300 to form a matching section which locks with the flared end 276 of the adaptor 274. Thus, when the adaptor 274 is placed in the recess 298–300 of one of the manifold housing sections 226, and the other inner housing section 226 is placed against the first section 226, the mounting adaptor 274 remains firmly in place until the two sections 226 are separated.

The cylindrical housing section 228 has two sets of slideway member 302 which define a receiving slot 304 for the edges of the two housing sections 226. Thus, when the two inner housing sections 226 are mounted one against the other, these can be slid into engagement with the slot 304 defined by the members 302. The mounting end of the cylindrical housing section 228 is formed with two cutouts which provide bearing faces 306 to facilitate engagement of the two inner housing sections 226 when it is desired to remove these sections 226. The two sections 226 are formed with notches 308 at the mounting end. By inserting an end of a screwdriver into the notches 308 and leveraging the screwdriver against the bearing surfaces 306, sufficient force can be generated to move the sections 226 out of the outer section 228. The two sets of slideway members 302 are so arranged that the sections 226 are located so that the branch passageways 244 are in proper communication with the discharge openings 246.

To review briefly the manner in which the roller assembly 214 is assembled, the end bearing member 260*a* is first placed over the mounting adaptor 274. Then the mounting adaptor 274 is either placed around (or has previously been permanently attached to) the outlet end 222 of the feed tube 212. This adaptor 274 is placed in the recess 298–300 of one of the inner housing sections 226, and the other section 226 is placed against the first section 226 to hold the adaptor 274 firmly locked in the two sections 226. The two sections 226 are then slipped into the slots 304 defined by the members 302 until the sections 226 are totally within the cylindrical housing section 228. The discharge roller cover 230 can then be slipped over the manifold housing 224 to the position shown in FIG. 16. Then the other end bearing member 260 is placed over the mounting member 266, and the retaining member 270 is threaded onto the member 272.

To review the overall operation of the present invention, a can of paint 18 is placed on the surface 22 of the housing section 20. The lid 36 is then placed over the paint can 18, and the tube 90 is inserted downwardly through the fitting 94. With the various tubes properly placed as described previously, and the roller assembly 214 in place, the painting operation begins by the person grasping the handle 162 of the applicator section 16 and moving the applicator roller 164 rearwardly (i.e. from the position of FIG. 12 to the position of FIG. 13).

As indicated previously, this pressurizes the passageway 112 to cause the switch 160 to close, which in turn starts the electric motor 32 to cause the pumping section 44 to operate. Paint is drawn from the container 18 through the tube 90 into the flexible pump tube 78. The paint flows from the tube 78 through the main paint passageway 110 in the delivery and control tube 104 to the applicator 16.

The paint flows through the feed tube 212 and into the plenum 236 of the manifold housing 224. As described earlier herein, the paint flows from the plenum 236 in a substantially symmetrical pattern through the passageways 242 and 244 to exit substantially evenly through the openings 246. The paint flows from the passageways 246 into the rather shallow area between the base or fabric 256 of the roller cover 230. It has been found that this manner of distribution causes the paint to flow in a substantially even pattern outwardly through the roller cover 230, so that as the person rolls the roller assembly 214 along the surface to be painted, there is an even application of paint.

When the person operating the apparatus 10 wishes to interrupt the flow of paint, he moves the pressurizing roller 164 forward to reduce the pressure in the air passageway 112. This causes an immediate shut off of the switch 160, with the consequent stopping of the motor 32 and operation of the pump 44. One of the desirable features of the prevent invention is that the response is immediate, and yet there is no need for electrical control means in the area of the control section 14.

Figure 10:
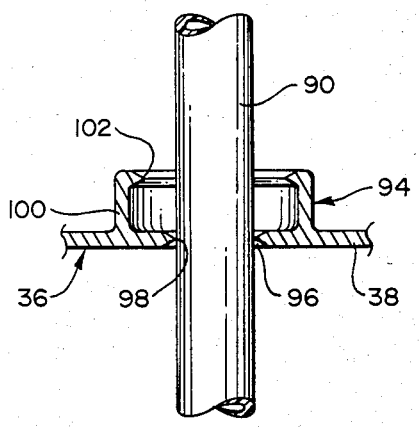
FIG. 10 is a sectional view taken along line 10—10 of FIG. 1, and illustrating the connection of an inlet tube through a lid of the supply section.
Figure 11:
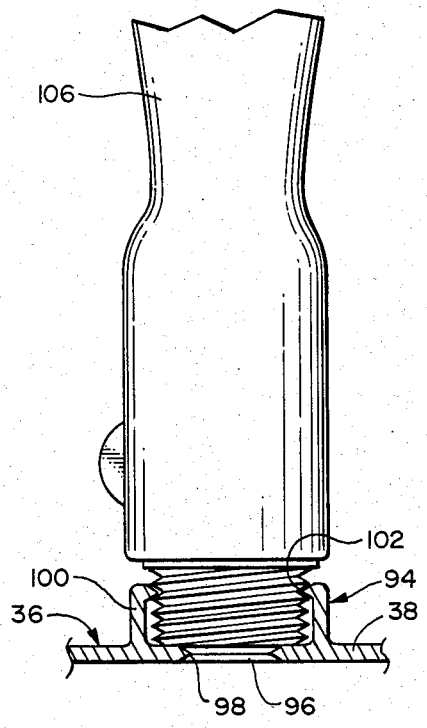
FIG. 11 is a view of the connection of the lid, but showing the outlet end of the delivery section being connected to the lid so that paint in the system can be returned to the paint can.

At the completion of the painting operation, the paint is discharged from the system in a particularly convenient manner, and this will be described with reference to FIGS. 10 and 11. The feed tube 90 is removed from the fitting 94. Also, the retaining nut 176 is removed from the threaded fitting 174 at the front end of the control handle 106. Then the fitting 174 is pressed into the flange 100 of the fitting 94 (see FIG. 11). Then the pressurizing roller 164 can be moved rearwardly to cause the system to operate. In this manner, the paint that remains in the system can be returned to the can 18.

Once the paint in the system has been removed through the control section 14 into the paint can 18, it now becomes necessary to flush the system so as to remove all of the residue of paint. The pump 44 is then activated to clean itself by pumping a flushing liquid, with the flushing liquid being discharged into a collecting container. Also, the retaining nut 176 can be attached to a standard garden hose fitting and then flushed clear by running water through the system for water base paint cleanup.

It is readily apparent from the above description that the various components of the apparatus 10 can be quite conveniently removed and cleaned. Attention is called particularly to the manifold housing 224. The roller cover 230 can be removed from the manifold housing 224 in a conventional manner, simply by slipping the cover 230 off the end of the manifold housing 224. If it is desired to disassemble the manifold housing 224 so that the component parts can be cleaned, as indicated previously, this can be accomplished by using a screwdriver or a similar tool, and inserting the screwdriver into the notches 308 formed in the two housing sections 226. Then the screwdriver or other tool can be rotated so as to bear against the surface 306 as a fulcrum for leverage, thus creating a substantial force to pull the housing sections 226 outwardly from the tubular housing section 228. When the sections 226 have been totally removed, they can be separated and the three housing components 226–228 can be cleaned.

Figure 19:
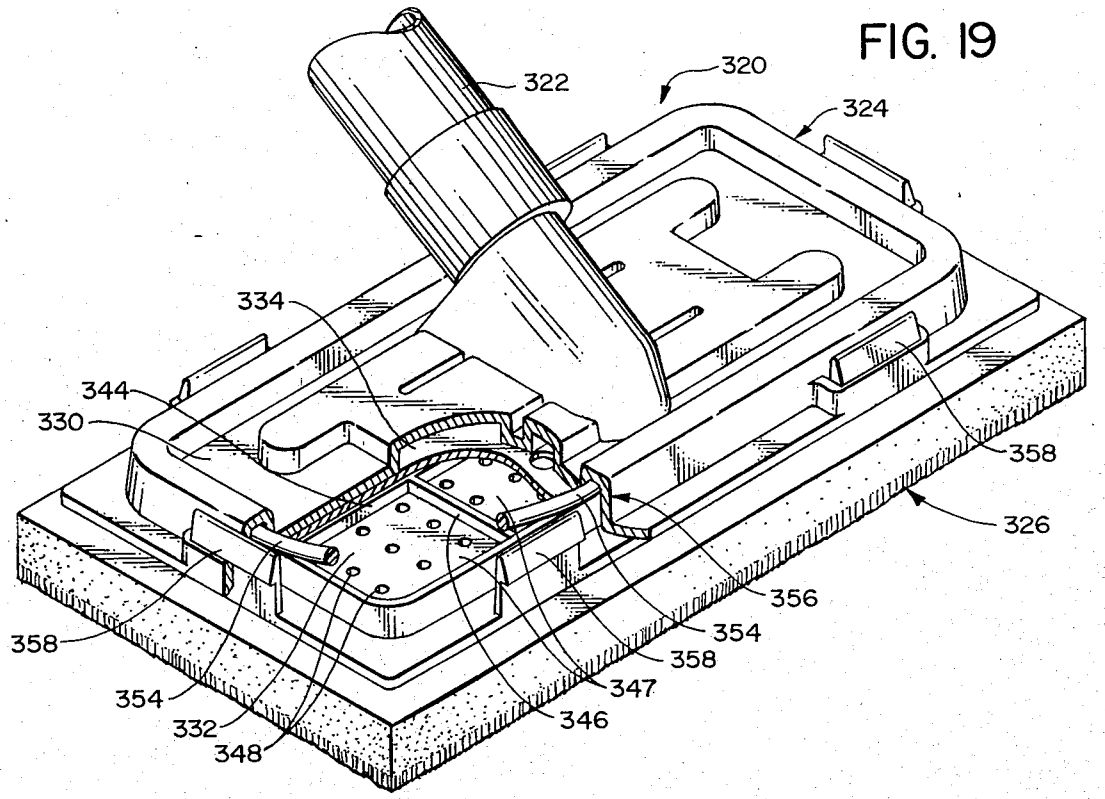
FIG. 19 is an isometric view illustrating a second embodiment of the discharge section of the present invention.
Figure 20:
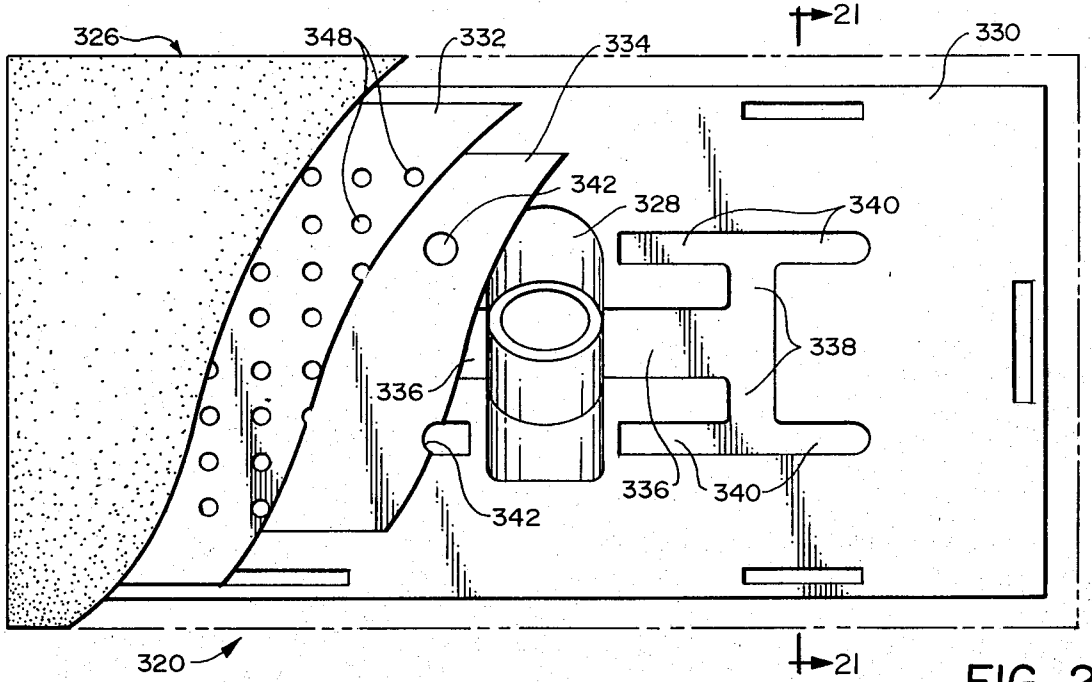
FIG. 20 is a top plan view of the second embodiment of FIG. 19, with layered sections being removed at three layer levels for purposes of illustration.
Figure 21:
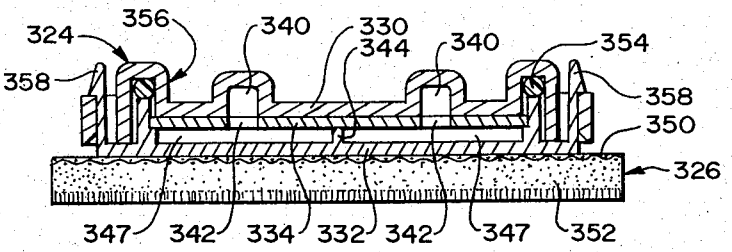
FIG. 21 is a sectional view taken along line 21—21 of FIG. 20.

A second embodiment of the applicator section is illustrated in FIGS. 19–21. In general, instead of having a rotating applicating cover, this embodiment incorporates a flat fixed pad which is moved over the surface which is being painted. This second embodiment incorporates generally the same type of manifold system for even distribution of the paint over the entire pad surface, so this second embodiment will be described only briefly.

This second embodiment of the applicator is generally designated 320, and it comprises generally a feed tube 322, a manifold housing 324, and a discharge pad 326. The manifold tube 322 leads into a plenum chamber 328 formed in the housing 324. This housing 324 comprises a top plate 330, a bottom plate 332, and an intermediate plate 334. The top plate 330 is contoured to form two main trunk passageways 336 that extend oppositely from one another along a longitudinal centerline of the applicator 320, with each trunk passageway 336 leading into oppositely extending transition passageways 338, each of which lead into a pair of oppositely extending branch passageways 340. The intermediate plate 334 is substantially planar and fits against the lower side of the plate 330 to form these closed passageways 336, 338 and 340. At the ends of the eight passageways 340, there are discharge openings 342, leading downwardly through the intermediate plate 334.

The bottom plate 332 has one lengthwise partition 344 and three transverse partitions, one of which is shown at 346. These partitions 344 and 346 separate the space between the plates 332 and 334 into eight separate compartments 347, each of which communicates with a related through opening 342.

The plate 332 is formed with a plurality of relatively small through openings 348 which lead to the discharge pad 326. The discharge pad 326 can of itself be made of conventional design, and as shown herein, it has an upper base or base fabric 350, and the lower foam or brush portion 352. The fabric or base portion 350 can be formed with a large plurality of small openings, and these openings can be made, for example, by piercing the fabric or base 350 at closely spaced regular intervals along its entire surface. These openings could be formed by a sharp rather thin piercing device (in the shape of what is conventionally called an "ice pick"), with the diameter of the piercing tool being about 0.002 of an inch. The pressure of the paint will cause the paint to flow through these many small openings and through the foam or brush portion 352 so as to be discharged onto the surface being painted.

The perimeter of the housing 324 is closed by a peripheral O-ring 354, and the perimeter portions of the upper and lower plates 330 and 332 are formed with an appropriate tongue-in-groove perimeter connection, indicated generally at 356 to properly locate the O-ring 354. Also, the lower plate 332 can be formed with appropriate snap fingers 358 to cause the upper and lower plates 330 and 332 to be joined to one another.

To describe the operation of this second embodiment, the supply section and the delivery and control section, which were described as components 12 and 14 in the earlier description, can be the same for the second embodiment. When paint is delivered into the feed tube 322, it flows into the manifold chamber 328, and thence through the passageways 336, 338 and 340, to be discharged through the openings 342. With the space between the plates 332 and 334 being formed into the eight separate compartments 347, the paint in each compartment 347 passes through the holes 348 formed in the base plate 332 and outwardly through the pad 326.

It can be readily recognized that the arrangement of the passageways 336, 338 and 340 applies the same general distribution principle as in the earlier embodiment of the manifold housing 224. Thus, there is a substantially uniform flow of the paint outwardly through the spaced openings 342, thus insuring substantially equal distribution of the paint being discharged through substantially the entire surface of the discharge pad 326.

It is obvious that various modifications could be made in the present invention without departing from the basic teachings thereof.

We claim:

1. A painting system, comprising:

a. a supply section comprising a pump adapted to pump liquid paint from a paint source;

b. an applicator section comprising an applicator to dispense the paint from the applicator;

c. a delivery and control section comprising:

1. a delivery tube having a receiving end to receive the paint from the pump, a delivery passageway to carry the paint, and a discharge end to deliver paint to the applicator;

2. an actuating tube having an interior passageway distinct from said delivery passageway to contain air, said tube having a first end proximate to the supply section and a second end proximate to the applicator section;

3. a pressure responsive pump switch operatively connected to the actuating tube and to the pump to cause the pump to operate, said switch having an on position and an off position, said switch defining an air pressure chamber which, when pressurized to a first higher pressure level, holds said switch in said on-position, and when at a second lower pressure level, enables said switch to move to said off-position;

4. a pressurizing switch proximate to the applicator section and operatively connected to the second end of the actuating tube, said pressurizing switch having a release position where air pressure in the actuating tube is decreased to said lower pressure level to move the pump switch to its off position to inactivate the pump and interrupt delivery of paint, and a pressurizing position to raise pressure in said air pressure chamber so as to move the pump switch to its on position to activate the pump and to maintain said pressure at said higher pressure level so as to hold said pump switch in said on-position to cause delivery of the paint, said pressurizing switch comprising a switch housing, compressible tube means mounted in said switch housing and having a lengthwise axis, a first end, opening to ambient atmosphere, and a second end, opening to the second end of the actuating tube, and a manually operable pressure control member movable along said lengthwise axis on an actuating path from said release position where said control member is proximate said first end, to said pressurizing position where said control member is proximate said second end of the tube means, said control member being mounted to said switch housing in a manner that when said control member moves from said release position, said control member squeezes said tube means at a location proximate the first end of the tube means at an intermediate squeeze-off position to close said tube means to ambient atmosphere, and as said control member moves from said intermediate squeeze-off position to said pressurizing position, said control member squeezes said tube means along said lengthwise axis to pressurize the air pressure chamber of the pump switch to said higher level.

2. The system as recited in claim 1, wherein said pressure control member comprises a roller member positioned to roll along said lengthwise axis of said compressible tube means, said roller member being provided with guide means to position said roller member relative to said tube means so as to close off said tube means and progressively compress said tube means as the roller member rolls along said tube means.

3. The system as recited in claim 2, wherein said roller member is arranged so that in the pressurizing position, engagement with the compressible tube section holds said roller member in the pressurizing position.

4. The system as recited in claim 3, wherein said roller member has an axis of rotation, and said roller member has a pair of oppositely positioned protruding members located on said axis of rotation, said protruding members being in operative engagement with said switch housing to constrain said roller member to movement along said actuating path.

5. The system as recited in claim 4, wherein said switch housing has an elongate slot proximate said tube means and extending along said lengthwise axis, said roller member being positioned in said slot for movement along said actuating path, with said protruding members engaging said switch housing on opposite sides of said slot.

6. The system as recited in claim 1, wherein said delivery and control section comprises:

a. said switch housing comprises a handle adapted to be grasped manually, and also adapted to be connected to the applicator;

b. said switch housing defining a through a passage for the flow of paint therethrough to the applicator;

c. said pressure control member comprising a roller member positioned to roll along said lengthwise axis of said compressible tube means, said roller member being provided with guide means to position said roller member relative to said tube means so as to close off said tube means and progressively compress said tube means as the roller member rolls along said tube means;

d. said roller member having an axis of rotation, and said roller member has a pair of oppositely positoned protruding members located on said axis of rotation, said protruding members being in operative engagement with said switch housing to constrain said roller member to movement along said actuating path;

e. said switch housing having an elongate slot proximate said tube means and extending along said lengthwise axis, said roller member being positioned in said slot for movement along said actuating path, with said protruding members engaging said switch housing on opposite sides of said slot.

7. The system as recited in claim 1, wherein said pump has a pump motor having a motor switch element as part of said pump switch, said pressure responsive pump switch further comprising structure defining a pressure chamber, a diaphragm closing one side of the pressure chamber and being responsive to increased pressure in the chamber to move outwardly from the chamber and being responsive to decreased pressure in the chamber to move inwardly towards the chamber, an actuating arm positioned to be responsive to outward movement of the diaphragm to move the motor switch element to cause the motor to operate and activate the pump, and also responsive to inward movement of the diaphragm to move the switch element to deactivate the pump.

8. The system as recited in claim 7, wherein said actuating arm has a first pivot end by which said actuating arm is mounted to said structure, and a second actuating end to engage the motor switch element, said diaphragm engaging the actuating arm intermediate its pivot end and its actuating arm intermediate its pivot end and its actuating end to cause a correspondingly greater movement of the actuating end relative to the movement of the diaphragm.

9. The system as recited in claim 7, wherein said delivery tube and said actuating tube are formed as an interconnected tube assembly, said system further comprising a connecting adaptor located at the receiving end of the delivery tube and at the first end of the actuating tube, said adaptor comprising a first connecting portion adapted to connect to the actuating tube, a second connecting portion adapted to be connected to the delivery tube, a third connecting portion adapted to be connected to a feed tube leading from said pump, said pressure chamber defining structure and said first, second, and third connecting portions being formed as an integral structure.

10. The system as recited in claim 1, wherein there is a pump motor having a motor switch, said pump switch comprising a first housing section defining a pressurizing chamber communicating with the passageway of the actuating tube, a second housing section engaging said first housing section, a diaphragm positioned between said fist and second housing sections and closing said pressure chamber, an actuating arm positioned between said diaphragm and said second housing section, said actuating arm having a first pivot end by which it is pivotally mounted to the second housing section, and a second actuating end adapted to operate said motor switch, said actuating arm and said diaphragm being arranged so that with said pressure chamber being pressurized, said diaphragm moves against said actuating arm to move the second actuating end to cause the motor switch to turn the motor on and operate the pump, and with said pressure chamber depressurized, said diaphragm moves away from said actuating arm to cause the motor switch to turn the motor off.

11. The system as recited in claim 1, wherein said delivery tube and said actuating tube are formed as a single unitary tube member providing the delivery passageway and the passageway of the actuating tube as adjacent passageways along said tube.

12. The system as recited in claim 1, wherein said pump comprises:

a. a pump housing having a center axis, and a curved wall section having an inwardly facing generally circularly curved pressure surface centered on said center axis;

b. a compressible pump tube having an inlet portion, an outlet portion, and an intermediate portion extending along said circularly curved pressure surface;

c. a center drive gear mounted at the center axis;

d. a plurality of pump gears positioned around and meshing with said drive gear, said pump gears arranged to travel in a circular path around said center axis in response to rotation of the drive gear and to exert an outward force to compress the pump tube along its length to cause a pumping action of said tube, said drive gear and said pump gears being positioned in a common operating plate generally perpendicular to said center axis;

e. said compressible pump tube and said curved pressure surface also being-positioned in said common operating plane in a manner that said pump tube is positioned between said cruved pressure surface and said pump gears and radial forces from said pump gears are transmitted directly to said pump tube; and f. a gear mounting frame to which said pump gears are rotatably mounted, said gear mounting frame being rotatably mounted to fixed structure so as to be maintained for rotation about said center axis, so as to maintain said pump gears in a proper radially spaced relationship from said center axis and to react forces on said pump gears directly into said gear mounting members, while substantially alleviating any lateral loading into said center drive gear.

13. The system as recited in claim 12, wherein there is a circumferential flexible band extending around said pump gears, with said band being positioned between said pump gears and said pump tube, so that pressure from said pump gears is transmitted through said band to the pump tube.

14. The system as recited in claim 12, wherein there is an intermediate gear connected to said center drive gear and centered at the center axis, said system further comprising a rotary pump motor having an axis of rotation spaced from said center axis, said motor having an output shaft operatively engaging said intermediate gear to drive said drive gear.

15. The system as recited in claim 14, wherein said intermediate gear and said drive gear are mounted to a shaft positioned at the center axis, said shaft being anchored to stationary structure at opposite ends thereof, said gear mounting frame being rotatably mounted to said shaft.

16. The system as recited in claim 1, wherein said supply section comprises:

a. a horizontally extending first housing section providing a horizontal platform to support a paint container at a paint containing area;

b. a vertically aligned second housing section connected to said first housing section and extending upwardly therefrom, said second housing section being spaced laterally from the containing area;

c. a pump motor having a vertical axis of rotation and being positoned in said second housing section, said pump motor having an output shaft extending downwardly from the motor and rotatable about said axis of rotation;

d. a drive gear means operatively connected to the output shaft of the pump motor and comprising a center drive gear rotatable about a vertical central axis;

e. a plurality of pump gears positioned around the drive gear means and in operative engagement therewith, said pump gears arranged to travel in a circular path around said center axis in response to rotation of said drive gear, said pump gears and said drive gear being mounted at a lower part of said second housing section in a common operating plate at approximately a level of said first housing section;

f. a pump housing portion having a wall section with an inwardly facing generally circular curved pressure surface surrounding said center axis, and positioned in said common operating plane at the level of the first housing section;

g. a compressible pump tube having an inlet portion, an outlet portion, and intermediate portion extending along said pressure surface, said pump tube being position in said common operating plane between said curved pressurc surface and said pump gears so that the pump tube is compressed along its length by the pump gears rotating about said center axis and exerting radial forces outwardly directly to said tube.

17. The system as recited in claim 16, wherein there is a gear mounting member to which said pump gears are rotatably mounted, said gear mounting member being rotatably mounted about said center axis so as to keep said pump gears in a proper radially spaced relationship from said center axis and to react forces on said pump gears directly into said second housing section.

18. The system as recited in claim 16, wherein said second housing section has a lower generally circular portion enclosing said pump tube, said pump tube having inlet and outlet ends located in said first housing section, and an intermediate portion extending in a generally circular path around the lower portion of the second housing section.

19. The system as recited in claim 18, further comprising a connecting member positioned in said first housing section, said connecting member having first and second connecting portions connected to, respectively, the inlet and outlet ends of the pump tube, a third connecting portion connecting to an inlet end of the delivery tube, a fourth connecting portion adapted to be connected to a feed tube leading to the inlet end of the pump tube, and a fifth connecting portion being connected to the actuating tube.

20. The system as recited in claim 19, wherein said pump motor has a motor switch, said pump switch comprising a first pump housing section formed integral with said connecting member and defining a pressurizing chamber communicating with the passageway of the actuating tube, a second pump housing section engaging the first pump housing section, a diaphragm positioned between said first and second pump housing sections and closing said pressure chamber, an actuating arm positioned between said diaphragm and said second pump housing section, said actuating arm having a first pivot end by which it is pivotally mounted to the second pump housing section, and a second actuating end adapted to operate said motor switch, said actuating arm and said diaphragm being arranged so that with said pressure chamber being pressurized, said diaphragm moves said actuating arm against said motor switch to turn the motor on and operate the pump, and with said pressure chamber being depressurized said diaphragm moves to cause said actuating arm to move away from said motor switch.

21. The system as recited in claim 1, wherein said applicator comprises:

a. a housing structure having a lengthwise axis and comprising an inner housing portion comprising first and second housing sections and a third outer housing section, said first, second, and third housing sections being adapted to be removably interfitted to form said housing structure as a unitary housing structure where the first, second, and third housing sections are fixedly positioned relative to one another in an operating position and define a plurality of feed openings along said lengthwise axis;

b. said inner housing portion having interior wall means which, with said first and second sections positioned against each other in said operation position, form distribution passageway means comprising an inlet, a plenum to receive paint from said inlet, and a plurality of distribution passageways defining flow paths leading from said plenum to each of said feed openings, said distribution passageways being characterized in that said flow paths have substantially similar length and cross-sectional configurations, whereby flow of paint through said flow paths is substantially uniform;

c. said third housing section having an overall generally cylindrical configuration and having interior slide way means extending along said lengthwise axis and arranged to slidably and removably receive said first and second sections in said operating position, said first and second housing sections being characterized in that with said first, second and third housing sections in said operating position, said first and second housing sections extend in side-by-side relationship along said lengthwise axis within said third housing section and along a substantial length dimension of said third housing section;

d. a discharge roller cover member having a generally cylindrical configuration and adapted to be rotatably mounted around said third housing section, said cover member having an outer applicator surface and being sufficiently permeable so as to permit flow of paint therethrough so as to receive flow of paint from said feed openings and to discharge paint at said outer applicator surface.

22. The system as recited in claim 21, wherein said passageways comprise a plurality of trunk passageways of larger cross-sectional area leading from said plenum, and a plurality of sets of branch passageways of smaller cross-sectional area, with each set leading from a related trunk passageway, whereby paint is distributed from the plenum first through said trunk passageways, and then through said branch passageways to said discharge zones.

23. The system as recited in claim 22, wherein said trunk passageways extent in opposite directions toward end portion of said housing structure and each set of branch passageways extend oppositely from its related trunk passageway.

24. The system as recited in claim 23, wherein said third housing section has circumferential lip members forming with said cover member discharge zones spaced axially along said lengthwise axis.

25. The system as recited in claim 21, wherein said applicator further comprises a feed tube to which said housing structure is mounted, a mounting adaptor adapted to be mounted to said feed tube, said first and second housing sections having matching recesses to fit against said mounting adaptor so as to be in locking engagement with said mounting adaptor.

26. The system as recited in claim 21, wherein said first and second housing sections have at one end portion thereof notch means, said third housing section being formed so as to expose said notch means and provide a bearing surface, whereby by applying a tool in the notch means and against the bearing surface, said first and second housing sections can be slid outwardly from said third housing section.

27. The system as recited in claim 1, wherein said supply section is provided with a lid to close a paint container, said lid having a tube receiving structure defining a through opening to receive a feed tube to withdraw paint from the paint container and deliver the paint to the pump, said tube receiving structure adapted to interfit with a discharge end fitting of the delivery and control section, whereby paint that is pumped through said delivery and control section can be returned to said paint container.

28. The system as recited in claim 1, wherein said pressurizing switch is characterized in that said control member is releasably held by said pressurizing switch means in said pressurizing position so as to maintain pressure in said air pressure chamber at said higher level.

29. The system as recited in claim 28, wherein said control member is held in the pressurizing position by means of engagement with said tube means.

30. An apparatus to supply pain for a powered painting system, said apparatus comprising:

a. a horizontally extending first housing section providing a horizontal platform to support a paint container at a paint containing area;

b. a vertically aligned second housing section connected to said first housing section and extending upwardly therefrom, said second housing section being spaced laterally from the containing area;

c. a pump motor having a vertical axis of rotation and being positioned in said second housing section, said pump motor having an output shaft extending downwardly from the motor and rotatable about said axis of rotation;

d. drive gear means operatively connected to the output shaft of the pump motor and comprising a center drive gear rotatable about a vertical center axis;

e. a plurality of pump gears positioned around the drive gear means and in operative engagement therewith, said pump gears arranged to travel in a circular path around said center axis in response to rotation of said drive gear, said pump gears and said drive gear being mounted at a lower part of said second housing section in a common operating plane at approximately a level of said first housing section;

f. said second housing section comprising a pump housing portion having a wall section with an inwardly facing generally circular curved pressure surface surrounding said center axis, and positioned in said common operating plate at the level of the first housing section;

g. a compressible Pump tube having an inlet portion, an outlet portion, and an intermediate portion extending along said pressure surface, said pump tube being positioned in said common operating plane between said curved pressure surface and said pump gears so that the pump tube is compressed along its length by the pump gears rotating about said center axis and exerting radial forces outwardly directly to said tube;

h. said pump tube having said inlet and outlet ends located in said first housing section, and extending outwardly therefrom.

31. The apparatus as recited in claim 30, wherein there is a gear mounting member to which said pump gears are rotatably mounted, said gear mounting member being rotatably mounted about said center axis so as to keep said pump gears in a proper radially spaced relationship from said center axis and to react forces on said pump gears directly into said second housing section.

32. The system as recited in claim 30, wherein said second housing section has a lower generally circular portion enclosing said pump tube, said pump tube having inlet and outlet ends located in said first housing section, and an intermediate portion extending in a generally circular path around the lower portion of the second housing section.

33. The system as recited in claim 32, further comprising a connecting member positioned in said first housing section, said connecting member having first and second connecting portions connected to, respectively, the inlet and outlet ends of the pump tube, a third connecting portion connecting to an inlet end of the delivery tube, a fourth connecting portion adapted to be connected to a feed tube leading to the inlet end of the pump tube, and a fifth connecting portion being connected to the actuating tube.

34. The system as recited in claim 33, wherein said pump motor has a motor switch, said pump switch comprising a first pump housing section formed integral with said connecting member and defining a pressurizing chamber communicating with the passageway of the actuating tube, a second pump housing section engaging the first pump housing section, a diaphragm positioned between said first and second pump housing sections and closing said pressure chamber, an actuating arm positioned between said diaphragm and said second pump housing section, said actuating arm having a first pivot end by which it is pivotally mounted to the second pump housing section, and a second actuating end adapted to operate said motor switch, said actuating arm and said diaphragm being arranged so that with said pressure chamber being pressurized, said diaphragm moves said actuating arm against said motor switch to turn the motor on and operate the pump, and with said pressure chamber being depressurized, said diaphragm moves to cause said actuating arm to move away from said motor switch.

35. The apparatus as recited in claim 30, further comprising a carrying handle, said carrying handle having a first mounting end connected to an upper end of said second housing section, and a handle portion exchange outwardly from said mounting portion over said paint containing area, said handle portion being positioned so that with a container of paint located on said first housing section, said handle portion is positioned generally above a center of gravity of said apparatus and said container of paint.

36. An applicator to receive paint unver pressure in a powered painting system and to dispense said paint, said apparatus comprising:

a. a housing structure having a lengthwise axis and comprising an inner housing portion comprising first and second housing sections and a third outer housing section, said first, second, and third housing sections being adapted to be removably interfitted to form said housing structure as a unitary housing structure where the first, second, and third housing sections are fixedly positioned relative to one another in an operating position and define a plurality of feed openings along said lengthwise axis;

b. said inner housing portion having interior wall means which, with said first and second sections positioned against each other in said operating position, form distribution passageway means comprising an inlet, a plenum to receive paint from said inlet, and a plurality of distribution passageways defining flow paths leading from said plenum to each of said feed openings, said distribution passageways being characterized in that said flow paths have substantially similar length and cross-sectional configurations, whereby flow of pain through said flow paths is substantially uniform;

c. said third housing section having an overall generally cylindrical configuration and having interior slide way means extending along said lengthwise axis and arranged to slidably and removably receive said first and second sections in said operating positions, said first and second housing sections being characterized in that with said first, second and third housing sections in said operating position, said first and second housing sections extend in side-by-side relationship along said lengthwise axis within said third housing section and along a substantial length dimension of said third housing section;

d. a discharge roller cover mexber having a generally cylindrical configuration and adapted to be rotatably mounted around said third housing section, said cover member having an outer applicator surface and being sufficiently permeable so as to permit flow of paint therethrough so as to receive flow of paint from said feed openings and to discharge paint at said outer applicator surface.

37. The apparatus as recited in claim 36, wherein said plenum is substantially centered at a center location relative to said lengthwise axis, with said passageways extending from said plenum toward opposite ends of said housing structure and at least some passageway portions leading back toward said center location.

38. The apparatus as recited in claim 36, wherein said third housing section has an outer generally cylindrical housing surface adjacent to and spaced moderately inwardly from an inside paint receiving surface portion of said cover member, and defining with said paint receiving surface portion a plurality of discharge zones spaced along said lengthwise axis, each of which has a depth dimension to permit flow of paint throughout said zone.

39. The apparatus as recited in claim 36, wherein said apparatus further comprises a feed tube to which said housing structure is mounted, a mounting adaptor adapted to be mounted to said feed tube, said first and second housing sections having matching recesses to fit against said mounting adaptor so as to be in locking engagement with said mounting adaptor.

40. The apparatus as recited in claim 36, wherein said first and second housing sections have at one end portion thereof notch means, said third housing section being formed so as to expose said notch means and provide a bearing surface, whereby by applying a tool in the notch means and against the bearing surface, said first and second housing sections can be slid outwardly from said third housing section.

41. The apparatus as recited in claim 31, wherein said distribution passageways comprise two upper and two lower trunk passageways extending oppositely toward end portion of the housing structure, and four pair of branch passageways, with each pair connecting to an outlet end of a related trunk passageway, and with the branch pasageways of each pair extending oppositely from one another, said upper trunk passageways extending oppositely from said lower trunk passageways to lead to feed openings which are positioned on opposite lateral surface portions of said third housing section, said feed openings being formed in said third housing section at spaced intervals along the lengthwise axis, with one set of said openings on one lateral side of said third housing section and a second set of said openings being on an opposite lateral side of said third housing section.

42. The apparatus as recited in claim 41, wherein said apparatus further comprises a feed tube to which said housing structure is mounted, a mounting adaptor adapted to be mounted to said feed tube, said first and second housing sections having matching recess to fit against said mounting adaptor so as to be in locking enagement with said mounting adaptor.

43. The apparatus as recited in claim 36, wherein said passageways comprise a plurality trunk passageways of larger cross-sectional area leading from said plenum, and a plurality of sets of branch pasageways of smaller cross-sectional area, with each set leading from a related trunk passageway and with the branch passageways of each set extending substantially oppositely from one another, whereby paint is distributed from the plenum first through said trunck passageways, and then through said branch passageways in opposite directions to said discharge zones.

44. The apparatus as recited in claim 43, wherein said plenum is at a center location in said housing structure and said trunk passageways extend in opposite directions toward end portions of said housing structure.

45. The apparatus as recited in claim 44, wherein said third housing section has circumferential lip members spaced axially along said lengthwise axis and protruding radially outwardly from said third housing section so as to space said cover member radially outwardly from said third housing member and to form with said cover member axially spaced discharge zones.

46. The apparatus as recited in claim 45, wherein there are at least four discharge zones located along the lengthwise axis of the housing structure.

47. A painting system, comprising:

a. a supply section comprising a pump adapted to pump liquid paint from a paint source;

b. an applicator section comprising an applicator to dispense the paint from the applicator;

c. a delivery and control section comprising:

1. a delivery tube having a receiving end to receive the paint from the pump, a delivery passageway to carry the paint, and a discharge end to delivery paint to the applicator;

2. a pump switch operatively connected to the pump to cause the pump to operate, said switch having an on-positioned and an off-position;

3. an activating switch proximate to the applicator section and operatively connected to said pump switch, said activating switch having a release position to move the pump switch to its off position to inactive the pump and interrupt delivery of paint, and an activating position to move the pump switch to its on position to activate the pump and cause delivery of the paint;

d. said supply section being provided with a lid to close a paint container, said lid having a tube receiving structure defining a through opening to receive a feed tube to withdraw paint from the paint container and deliver the paint to the pump, said tube receiving structure adapted to interfit with a discharge end fitting of the delivery and control section, whereby paint that is pumped through said delivery and control section can be returned to said paint container.

48. A method of clearing a powered painting system of paint, said method comprising:

a. providing an apparatus comprising:

1. a supply section comprising a pump adapted to pump liquid paint from a paint source;

2. an applicator section comprising an applicator to dispense the paint from the applicator;

3. a delivery and control section comprising:

i. a delivery tube having a receiving end to receive the paint from the pump, a delivery passageway to carry the paint, and a discharge end to deliver paint to the applicator;

ii. a pump switch operatively connected to the pump to cause the pump to operate, said switch having an on-position and an off-position;

iii. an activating switch proximate to the applicator section and operatively connected to said pump switch, said activating switch having a release position to move the pump switch to its off position to inactivate the pump and interrupt delivery of paint, and an activating position to move the pump switch to its on position to activate the pump and cause delivery of the paint;

4. said supply section is provided with a lid to close a paint container, said lid having a tube receiving structure defining a through opening to receive a feed tube to withdraw paint from the paint container and deliver the paint to the pump, said tube receiving structure adapted to interfit with a discharge end fitting at the delivery and control section:

b. operating said pump to cause paint to be discharged through said delivery and control section for painting;

c. removing said feed tube from said lid and from said paint container;

d. disconnecting said end fitting from the delivery and control section and inserting said end fitting into said opening in the lid;

e. operating said pump to cause paint to be moved through said delivery tube and into said paint container.

* * * * *